US011122907B2

(12) United States Patent
Brandtner et al.

(10) Patent No.: US 11,122,907 B2
(45) Date of Patent: Sep. 21, 2021

(54) UPHOLSTERED FURNITURE INCLUDING MOLDED FURNITURE COMPONENTS

(71) Applicant: Ashley Furniture Industries, LLC, Arcadia, WI (US)

(72) Inventors: Timothy A. Brandtner, Ettrick, WI (US); Nicholas J. Robinson, Ettrick, WI (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 39 days.

(21) Appl. No.: 16/525,539

(22) Filed: Jul. 29, 2019

(65) Prior Publication Data

US 2020/0029699 A1 Jan. 30, 2020

Related U.S. Application Data

(60) Provisional application No. 62/711,168, filed on Jul. 27, 2018.

(51) Int. Cl.

| | |
|---|---|
| ***A47C 7/24*** | (2006.01) |
| ***B68G 7/00*** | (2006.01) |
| ***A47C 17/86*** | (2006.01) |
| ***A47C 7/30*** | (2006.01) |

(52) U.S. Cl.

CPC ..... *A47C 17/86* (2013.01); *A47C 7/24* (2013.01); *A47C 7/30* (2013.01); *B68G 7/00* (2013.01)

(58) Field of Classification Search

CPC .. A47C 17/86; A47C 7/24; A47C 7/30; A47C 5/00; A47C 31/02; B68G 7/00

See application file for complete search history.

(56) References Cited

U.S. PATENT DOCUMENTS

| | | | |
|---|---|---|---|
| 1,716,176 | A | 6/1929 | Vitez-Keresztfalvy |
| 2,838,100 | A | 6/1958 | Follows |
| 3,104,913 | A | 9/1963 | Faulkner et al. |
| 3,115,093 | A | 12/1963 | Andrus |
| 3,333,841 | A | 8/1967 | Damiano |
| 3,375,861 | A | 4/1968 | Marlow |
| 3,414,912 | A | 12/1968 | Dusey, Sr. et al. |
| 3,467,433 | A | 9/1969 | Lindau et al. |
| 3,497,883 | A | 3/1970 | Arnold et al. |
| 3,498,598 | A | 3/1970 | Rathbun |
| 3,528,096 | A | 9/1970 | Moberg |

(Continued)

FOREIGN PATENT DOCUMENTS

WO WO 2018/081471 A1 5/2018

OTHER PUBLICATIONS

International Search Report for Application No. PCT/US2019/044000 dated Nov. 26, 2019 (4 pages).

*Primary Examiner* — Lawrence Averick

(74) *Attorney, Agent, or Firm* — Christensen, Fonder, Dardi & Herbert PLLC; Douglas J. Christensen

(57) ABSTRACT

An upholstered piece of furniture including a frame having a front frame member, an opposing back rest, and two arms at opposite ends of front frame member and backrest, wherein at least one of the front frame member and opposing back rest includes a wood component, and wherein the arms are made of molded plastic and at least one of the arms is coupled to the wood component. The upholstered piece of furniture includes covering material, wherein at least a portion of the at least one of the arms is covered by the covering material.

10 Claims, 23 Drawing Sheets

(56) References Cited

U.S. PATENT DOCUMENTS

| | | | | |
|---|---|---|---|---|
| 3,642,323 | A | 2/1972 | Taylor | |
| 3,658,382 | A | 4/1972 | Anderson | |
| 3,669,495 | A | 6/1972 | Von Rudgisch | |
| 3,700,282 | A | 10/1972 | Rowland | |
| 3,722,954 | A | 3/1973 | Rey et al. | |
| 3,874,727 | A | 4/1975 | Mehbert et al. | |
| 3,877,087 | A | 4/1975 | Harty | |
| 3,887,234 | A | 6/1975 | Curtis et al. | |
| 4,165,902 | A | 8/1979 | Ehrlich | |
| 4,285,080 | A | 8/1981 | Kitchen et al. | |
| 4,285,544 | A | 8/1981 | Zapf | |
| 4,768,833 | A | 9/1988 | Virtue | |
| 4,775,187 | A | 10/1988 | Herr | |
| 5,411,316 | A | 5/1995 | Lovegrove et al. | |
| 5,575,533 | A | 11/1996 | Glance | |
| 5,582,460 | A | 12/1996 | Schultz | |
| 5,727,849 | A | 3/1998 | Nelson | |
| 5,755,489 | A | 5/1998 | Rossman et al. | |
| 5,775,778 | A | 7/1998 | Riley et al. | |
| 6,109,687 | A | 8/2000 | Nye et al. | |
| 6,241,312 | B1 | 6/2001 | Watts et al. | |
| 6,679,558 | B2 | 1/2004 | Adams et al. | |
| 6,702,391 | B1 | 3/2004 | Stipek | |
| 6,854,806 | B2 | 2/2005 | Huse | |
| 6,883,873 | B2 * | 4/2005 | Haney | A47C 11/00 297/451.8 |
| 6,945,178 | B1 | 9/2005 | Nye et al. | |
| 7,011,787 | B2 | 3/2006 | Huse | |
| 7,070,243 | B1 | 7/2006 | Frank | |
| 7,438,362 | B2 | 10/2008 | Dotta et al. | |
| 7,568,767 | B2 | 8/2009 | Richardson | |
| 7,713,011 | B2 | 5/2010 | Orszagh et al. | |
| 7,806,482 | B2 | 10/2010 | Dotta et al. | |
| 7,988,236 | B2 | 8/2011 | Brandtner | |
| 8,438,716 | B2 | 5/2013 | Brandtner | |
| 8,448,314 | B2 | 5/2013 | Brandtner | |
| 8,764,115 | B2 | 7/2014 | Brandtner | |
| 8,777,319 | B2 | 7/2014 | Brandtner et al. | |
| 9,028,185 | B2 | 5/2015 | Eggers et al. | |
| 9,309,914 | B2 | 4/2016 | Yuan | |
| 9,474,381 | B2 | 10/2016 | Brandtner et al. | |
| 9,526,342 | B2 * | 12/2016 | Thuma | B29C 49/0015 |
| 9,609,943 | B1 | 4/2017 | Lin | |
| 9,651,080 | B2 | 5/2017 | Eggers et al. | |
| 9,839,295 | B2 | 12/2017 | Robinson et al. | |
| 9,839,298 | B2 | 12/2017 | Stirling | |
| 10,034,554 | B2 | 7/2018 | Lewis et al. | |
| 10,117,521 | B2 | 11/2018 | Lewis et al. | |
| 1,018,821 | A1 | 1/2019 | Thuma et al. | |
| 10,299,606 | B2 | 5/2019 | Lewis et al. | |
| 1,032,755 | A1 | 6/2019 | Neil et al. | |
| 10,869,560 | B2 * | 12/2020 | Gates | A47C 31/04 |
| 2003/0209934 | A1 * | 11/2003 | Haney | A47C 11/00 297/440.15 |
| 2004/0041452 | A1 | 3/2004 | Williams | |
| 2011/0035875 | A1 | 2/2011 | Brandtner | |
| 2012/0204392 | A1 | 8/2012 | Luangphon | |
| 2013/0316123 | A1 | 11/2013 | Preisler et al. | |
| 2013/0320741 | A1 | 12/2013 | Brandtner et al. | |
| 2014/0375103 | A1 | 12/2014 | Lejcher et al. | |
| 2015/0130233 | A1 * | 5/2015 | Thuma | A47C 4/03 297/188.1 |
| 2016/0106219 | A1 | 4/2016 | Stirling | |
| 2019/0254440 | A1 * | 8/2019 | Gates | A47C 31/023 |

* cited by examiner

UPHOLSTERED FURNITURE INCLUDING MOLDED FURNITURE COMPONENTS

CROSS-REFERENCE TO RELATED APPLICATION

This application claims the benefit of U.S. Provisional Application No. 62/711,168, filed Jul. 27, 2018, the entire contents of which is incorporated by reference herein.

FIELD OF THE DISCLOSURE

The present disclosure generally relates to upholstered furniture and, more particularly, upholstered furniture including one or more molded components.

BACKGROUND OF THE DISCLOSURE

Upholstered seating furniture where essentially the entirety of the exposed furniture items are covered by upholstery coverings is one of if not the highest volume items sold in the residential retail furniture markets and thereby provides one of the highest revenue sources for retail furniture stores. The market for such upholstered seating furniture is fiercely competitive and any improvements in manufacturing resulting in an improved product, better value to the customer, and/or lower manufacturing costs are welcomed by the industry.

In the manufacture of such upholstered seating furniture items, such as sofas, love seats, recliners, and similar items, the structure for the upholstered furniture items is provided by a frame or chassis, which gives the furniture structural support and also provides its basic shape. Traditionally, frames for upholstered furniture items have been typically constructed of wood materials, such as hardwood, softwood, engineered woods (for example, plywood, hardboard, millboard, chipboard, and fiberboard). Portions of the wooden frame may typically be covered by padding or cushioning, such as foam, and then covered with fabric, leather, synthetic fabric, faux leather, microfiber, or other upholstery. Due to the large number of parts and the weight of their materials, wooden furniture frames are often heavy and have long assembly times due, in part, to the large number of parts they include. For example, a single arm alone for upholstered chairs, recliners, and sofas can include up to and over 10 or 15 different wood parts not including the multitude of fasteners needed for assemble. Each wood part, of course, needs to be precisely cut. Further, a single backrest for a chair or recliner can include up to and over 10 or 15 different wood parts not including the multitude of fasteners.

Additionally, attaching upholstery to the complex shape of wooden sofa frame arms also can be painstakingly tedious in that the wooden frames have gaps that need to be covered with cardboard or the like, the upholstery components, including padding, does not slide on the wood frame for positioning and as such, the upholstery needs to be precisely positioned by hand. Any improvement in ease of attaching upholstery components to sofa frame arms would be well received by furniture manufacturers.

Moreover, due to non-uniformity of wood, the use of multiple wood pieces in constructing sofa and chair components, such as arms, is only as strong as the weakest wood piece and can present difficult quality control issues. Moreover, wood pieces can crack when fasteners, are driven into the pieces during assembly of the furniture item.

The above-described process of manufacturing upholstered furniture items is time consuming and costly due to the number of parts must be manually assembled to construct the final upholstered furniture item. As such, there is a need for a simplified method for manufacturing upholstered furniture items that reduces labor and material costs while providing a product that provides a sufficient or improved level of support and comfort to the user.

Although there have been efforts to utilize plastic components in seating furniture, such efforts have not been commercially successful with regard to upholstered seating furniture and have not taken advantage of the respective attributes and disadvantages of plastic and wood.

SUMMARY

The embodiments of the present disclosure include upholstered seating furniture in which the number of components that need to be assembled is minimized, that is simpler to assemble, where the time for assembly is minimized, and where the finished product is robust and sturdy. The inventors have identified an optimal and synergistic use of polymer structural components and non-polymer structural frame components, such as wood frame members, to provide such attributes.

In embodiments, an upholstered seating furniture item configured as a sofa includes a seat base with seating cushions, a cushioned back rest and a pair of arm rests with padding. The seat base, the cushions, the pair of arm rests all covered with upholstery on all visually exposed regions, specifically the top and sides of the sofa. The sofa having a sofa frame or chassis including a pair of blow molded arm rest forms separated by a separation distance, and a plurality of spanning wood frame members, each of the plurality of spanning wood frame members extending between the pair of molded arm rests, each spanning wood frame member having a length greater than the separation distance and having wood frame member ends nested within recesses in the respective blow molded arm rest forms. One or more of the plurality of wood frame members attached to each of the pair of blow molded arm rest forms by way of a plurality of metal screws extending into a plurality of metal threaded inserts in the respective arm rest forms. Vertical back rest frame members and a seat deck components are supported by and attached to the spanning frame members. The upholstery covering the side arm rest forms, the back rest, and the cushions such that substantially the entirety of the exposed regions of the sofa are covered by the upholstering.

A feature and advantage of embodiments is a furniture item including a pair of opposing arm member forms each unitarily formed from a single piece of polymeric material. This structural arrangement provides ease of assembly and cost efficiencies by minimizing the number of parts and minimizing the number of assembly steps. In embodiments, wooden cross members extend between the pair of opposing arm member forms. In embodiments, each arm member defines a plurality of corresponding recesses, each of the corresponding recesses being dimensioned and positioned to receive an end portion of a wooden cross member. In embodiments, a plurality of threaded metal inserts are supported by each of the arm members. Each of the threaded metal inserts may receive a threaded fastener that aids in constraining a wooden cross member relative to the arm member.

A feature and benefit of embodiments is an upholstered furniture item have covering material in the form of an upholstery sack positioned over at least a portion of the upholstered furniture item, including each of the arm portions. In embodiments, the upholstery sack includes padding that provides a higher level comfort for users of the upholstered furniture item. In embodiments, the upholstered furniture item further includes a padding, wherein at least a portion of each of arm portions is covered by the padding, such that the pad is intermediate the molded component and covering material.

A feature and advantage of embodiments is a furniture item including a pair of opposing arm members, each of the arm members comprising a hollow shell comprising a polymeric shell wall, an inward facing surface of the polymeric shell wall defining a void volume, the polymeric shell wall having a plurality of low friction polymeric outward facing surfaces. In embodiments, the low friction polymeric outward facing surfaces provided by the polymeric shell wall facilitate the pulling of upholstery covering materials over the arm portions of the furniture item. In embodiments, the polymeric shell wall gives structural support and also provides a fundamental shape to the arm portions of the furniture item.

A feature and advantage of embodiments is a furniture item including an arm portion integrally formed from a single piece of thermoplastic material. This arrangement allows the arm portion body to be fabricated using an automated and efficient thermoplastic injection molding processes.

A feature and benefit of embodiments is a furniture item including an arm member having cross member receiving recesses that orient wooden cross members of the furniture. In embodiments, each of the cross member receiving recesses is shaped and dimensioned to receive an end portion of a wooden cross member while the wooden cross member is disposed in a predetermined orientation relative to the arm member. In embodiments, the arrangement facilitates fixture-less alignment and assembly of the subcomponents.

A feature and benefit of embodiments is a furniture item including an arm member having a plurality of mounting features. In these embodiments, the plurality of mounting features allow the arm member to be utilized in various types/models of furniture items. Examples of furniture items include sofas, loveseats, chairs, sectional sofas, seating units, sleeper sofas, futon frames, and recliners.

A feature and benefit of embodiments is a furniture item including an arm member defining a groove, the groove receiving the distal end of a cross member to form a tongue and groove joint. In embodiments, the groove extends upward and downward along a groove axis. In embodiments the groove is shaped and dimensioned to receive an end portion of a wooden cross member, an end portion of a wooden cross member having a uniform thickness along its length. In embodiments, a wooden cross member may be slid downward with each of the ends of the cross member being received in grooves defined by opposing arm member to facilitate fixture-less alignment and assembly of the subcomponents of a furniture item.

A feature and advantage of embodiment is a furniture item having arm portions with less than three layers of material between the arm portion and the upholstery covering. In embodiments, the arm portion has a top curved surface about a horizontal axis. In embodiments, the layers between the arm portion and the upholstery covering comprise an EVA underlayer and a second layer of fibrous material thereon. A feature and advantage is arm portion that does not have a cardboard layer extending across a wooden frame as in many conventional assemblies.

A feature and advantage of embodiments is a recline which, compared to conventional recliners, the number of components needed to assemble the recliner is greatly reduced, the difficulty of assembly is greatly reduced, the time of assembly is greatly reduced, and the expense is correspondingly greatly reduced. Moreover the structural integrity is generally greater.

In embodiments, a method of making an upholstered seat includes providing a seat frame including a front frame member, an opposing back rest, and two arms at opposite ends of front frame member and backrest, wherein at least one of the front frame member and opposing back rest includes a wood component, and wherein the arms are made of molded plastic; coupling at least one of the arms is coupled to the wood component; and covering at least a portion of the at least one of the arms with a covering material.

A feature and advantage is that the inventors have discovered that utilizing certain polymers, such as polyethylenes, can received staples comparable to wood frame members. This facilitates utilization of the polymer arm rest forms in existing furniture assembly lines.

A feature and advantage of embodiments, a blow molded arm rest form may have a wall thickness of from 2 to 6 mm. This thickness provides stabilization and secure holding of frame components connected thereto, while providing an arm rest form that is more resilient that a prior art wooded arm rest frame. Such resilience can reduce the amount of cushioning material needed compared to conventional wood framed arm rest forms.

In embodiments, attachment of the upholstery is simplified by the very low coefficient of friction between the sofa arm form and the upholstery material, allowing conformingly sized upholstery arm portions to be readily slid over the arm forms. In embodiments, this facilitates construction of more complete upholstery kits at locations remote from the final sofa assembly site of the sofa. For example, upholstery kits can include arm rest sock portions that already have arm rest padding attached to the upholstery covering material. This can eliminate the steps of manually having to attach one or more layers of padding at the final sofa assembly site before attaching the arm rest upholstered portions.

A feature and advantage of embodiments is that segregation of manufacturing sites for components of the upholstered seating furniture items is enhanced. For example, padding for arm rests can be attached to arm rest upholstery portions as part of an upholstery kit in remote locations from the final seating furniture assembly location. Additionally, the arm rest forms may each be molded at a location remote from the final seating furniture assembly location and transported to the final seating furniture assembly location.

A feature and benefit of embodiments is an arrangement for furniture items in which the number of components that need to be assembled is minimized, is simple to assemble and the time for assembly is minimized, and is robust and sturdy.

A feature and advantage of embodiments is that the specific attributes of polymers and wood have been combined in a synergistic fashion for construction of a wood frame or chassis for upholstered seating furniture. For example, conventional polymers suitable for geometrically large components, such as furniture components, for example polyethylenes, when subjected to tensile loading or significant sheer loading may creep over time and may loose load carrying strength. However, three dimensional polymer forms, particularly hollow polymer forms have reasonable compressive load carrying capabilities. That is downward weight loading will not generally cause noticeable creep of the polymer making certain polymers such as polyethylenes suitable for arm rest forms. Where such arm rest forms are utilized for some limited downward compressive loading, any diminishment of the strength of the polymer over time should not affect the integrity of the sofa frame and sofa. Polymers have great capabilities and flexibilities in securing components, such as wood frame members that are not continually loaded. In embodiments of the invention, no loading from seating is isolated on the polymer arm rest forms, rather the loading is carried directly downward from the seating deck to a lower front rail and a lower back rail that are both positioned at the lower margin of the sofa. Where there are no feet on the sofa, the loading from seating will be transferred to the floor surface along the length of both the front rail and back rail. Where, there are feet on the sofa, the front rail and rear rail will act as end supported beams, and the floor engaging feet will be positioned under the ends of the front and rear rail and transfer the load to the floor by the feet.

Wood on the other hand, has great load carrying capability between supported ends when properly oriented. The use of wood spanning frame members to support the weight of people sitting on sofas in association with the polymer arm rest forms provides more than sufficient strength to support people sitting on the sofa, and provides same with minimal component parts, minimal assembly time, and potentially reduced cost. An optimal solution is to minimize load carrying of large blow molded components A feature and advantage of embodiments is the use of a plurality of spanning wood frame members between a pair of polymer arm rest forms, where seating load carrying spanning wood frame members seat on upwardly facing surfaces of the polymer arm rest. In embodiments the upwardly facing surfaces are load carrying platforms portions formed in an inner wall portion of hollow arm rest form whereby the seating load transferred to the platform portions by ends of the spanning wood frame members is distributed to the inner facing wall portion above, below, forwardly and rearwardly of the platform portion. In embodiments, the spanning frame members may be formed of metal rather than wood with some of the same advantages.

A feature and advantage of embodiments are blow molded polymer arm rest forms that have a plurality of vertical recesses in the wall portions for adding structural strength to the arm rest form. A feature and advantage of embodiments is use of a polyethylene for arm rest forms, and with threaded inserts having an internal threaded surface placed at spanning member attachment points in polymer wall portions for receiving screws that extend through spanning frame members for securing the spanning frame members to the polymer arm rest forms. In embodiments, the threaded inserts have an external thread and are threaded into the polymer wall portions of the arm rest forms. In embodiments the spanning member attachment points are at recesses in the wall portions of the arm rest forms whereby an end of the spanning member will nest into the recess, the nesting providing secure fixation of the component with respect to the arm rest forms.

A feature and advantage of embodiments is a furniture seating item with a rectangular base, with opposing side polymer structural supports defining opposing short sides of the polymer base and with wood base boards defining the long sides of the rectangular base, ends of the wood base boards connecting with the polymer structural supports, and wherein the rectangular base supports a seating platform, and a back rest, and wherein all load carrying components of the furniture seating item are connected directly to or connected by way of metal or wood components to at least one of the a forward and rearward non-polymer supports. In other words, none of the loaded components transfer any loading upon them exclusively to the polymer structural supports, such loading is shared or primarily carried by the non-polymer frame structures. In embodiments, floor engaging feet are placed under the four ends of the wood base boards to support the loading of the seating item. By way of the feet, loading by sitting Other than the sofa feet, there are no isolated polymer structures, such as legs, carrying the load of the furniture seating item.

In embodiments of the invention, arm rests for a stationary upholstered seating item such as a sofa, each have a hollow polymer arm rest form weighing from about 6 to 10, saving 10 to 16 pounds for both arm rest forms compared to conventional wood framed arm rest forms. In embodiments of the invention, recliner arm rest forms can save 14 to 19 pounds for two blow molded arm rests compared to conventional wood framed arm rest forms. In recliners, a 50% reduction in the weight from the arm rests is available by using blow molded polymer arm rest forms over conventional wood framed arm rests.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
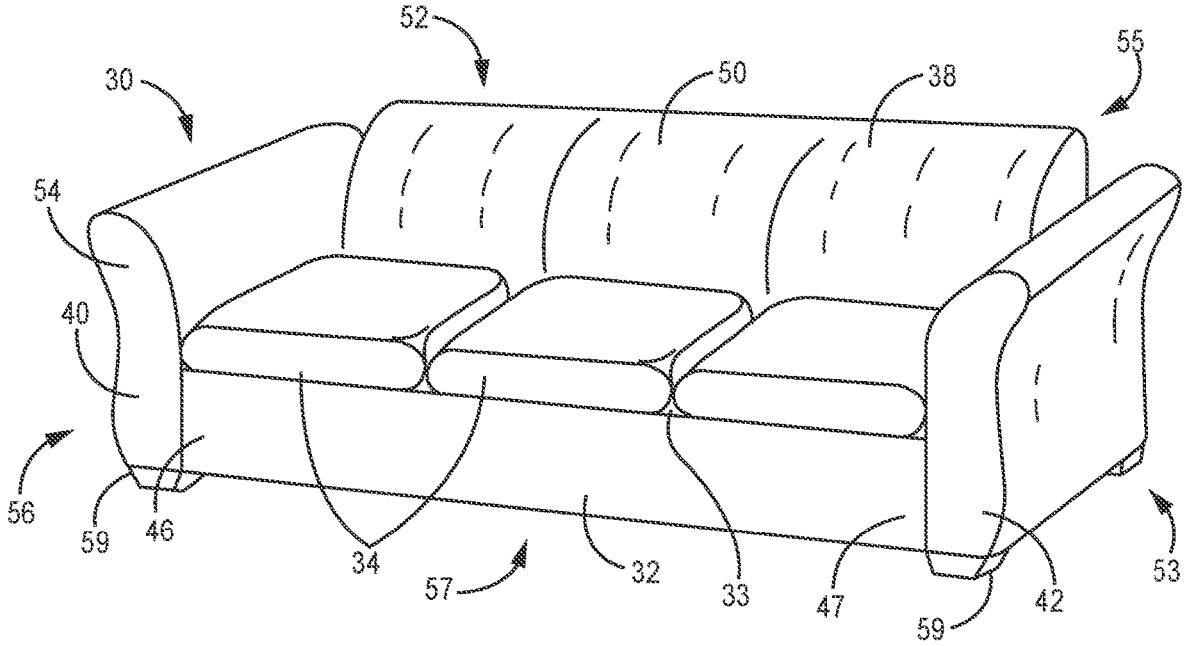
FIG. 1A is a perspective view of an upholstered sofa in accord with embodiments.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1A, an upholstered sofa 30 is illustrated. The sofa 30 generally has a seat base 32 with a seat deck 33, seat cushions 34 on the seat deck, an upright back rest 38 extending from the seat base, and a pair of arm rests 40, 42 connecting to opposing ends 46, 47 of the seat base. Upholstery 50 covers exposed portions of the arm rests, seat base, back rest and cushions. That is the top side 52, left side 53, right side 54, back side 55, and front side 56 of the sofa has upholstery thereon. The bottom side 57 may have upholstery panels folded and attached to the frame but is generally not fully covered with upholstery. Sofa feet 59 attach to the sofa at the bottom side and provide separation of the sofa base from a floor surface. When used herein, upholstery includes fabrics, leather, synthetic fabrics, faux leather, microfibers, or other sheet materials used as coverings for sofas.

Figures 1B, 1C:
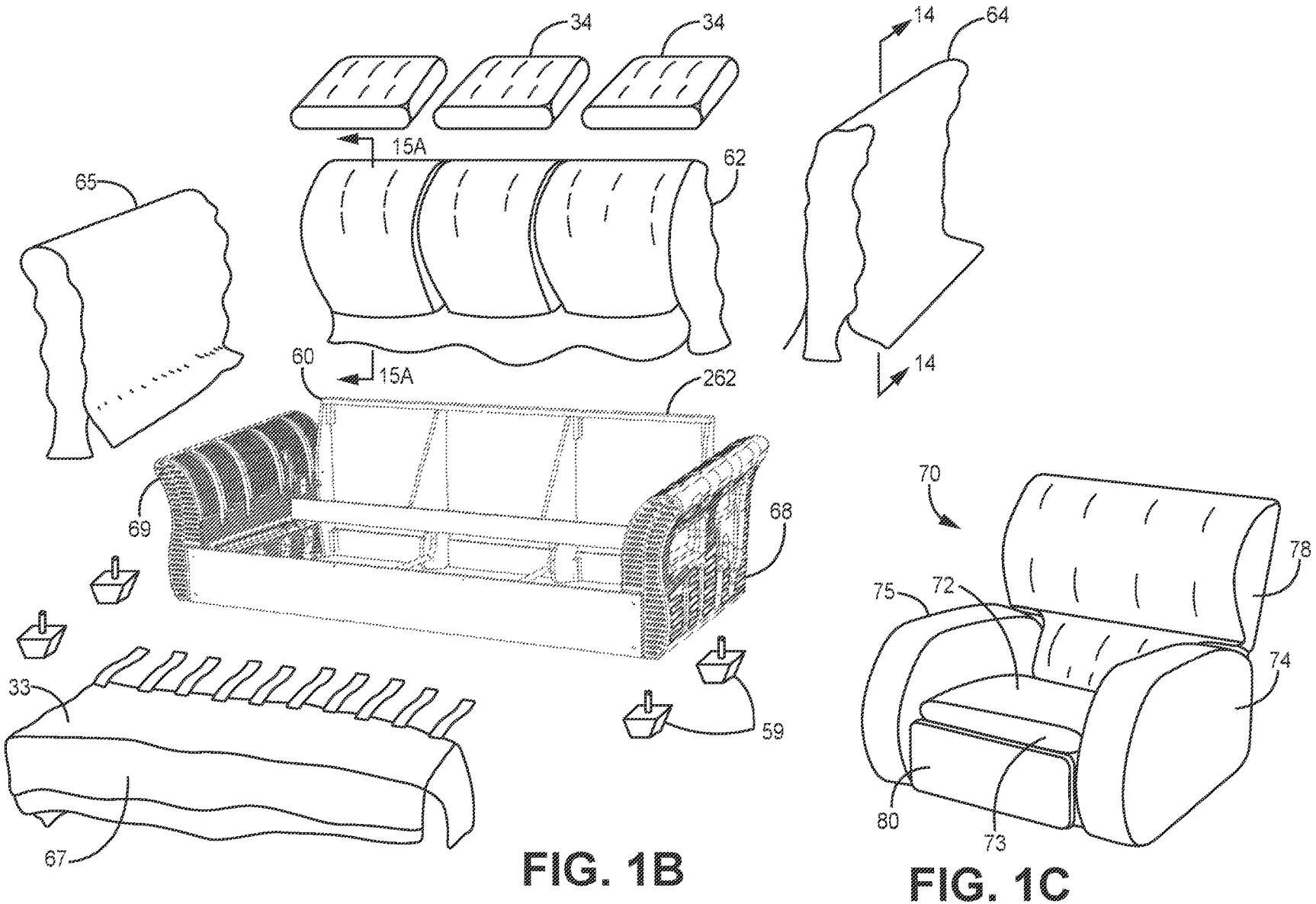
FIG. 1B is an exploded view of the sofa of FIG. 1A in accord with embodiments including two molded polymer arm rest forms.
FIG. 1C is a perspective view of an upholstered recliner in accord with embodiments.

Referring to FIG. 1B, further components of the sofa are depicted and include a structural frame 60, seat back upholstery portion 62, arm rest upholstery portions 64, 65, a forward base upholstery portion 67 attached to the seat deck 33. The seat deck may be a textile seat deck as described in WO 2018/081471 which is owned by the owner of this application and is incorporated by reference herein for all purposes. Alternatively, the seat deck may comprise conventional steel springs as are well known. The structural frame 60 includes unitary polymer arm rest forms 68, 69 discussed in detail below.

Figure 1D:
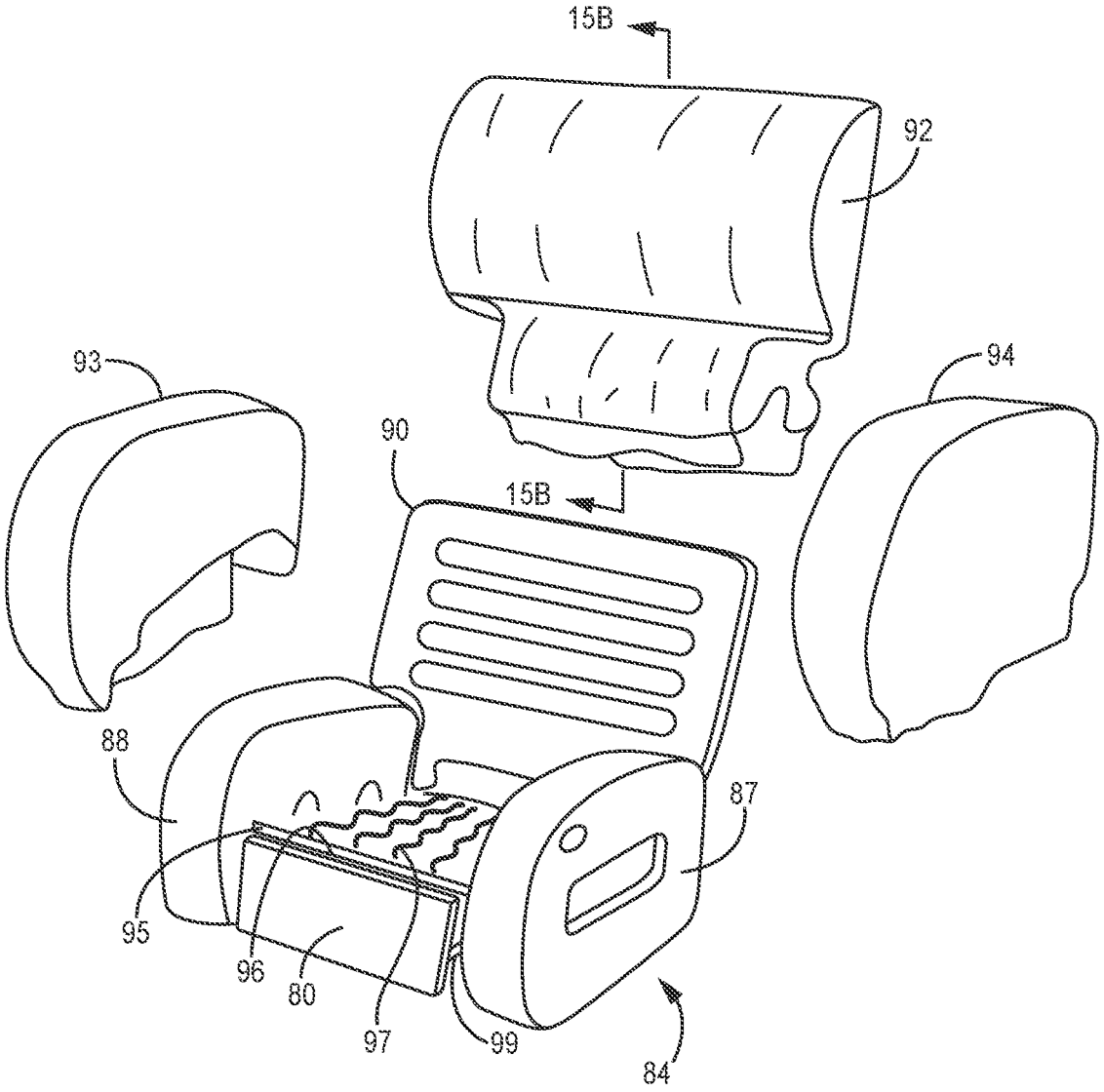
FIG. 1D is an exploded view of the upholstered recliner of FIG. 1C.

Referring to FIG. 1C, a recliner 70 has a seat 72 with a seat cushion 73, a pair of arm rests 74, 75, a back rest 78, and an ottoman 80. Referring to FIG. 1D, the recliner further has a recliner frame 84, comprising a pair of polymer arm rest forms 87, 88 and a back rest form 90. The arm rest forms are each unitary and molded such as by blow molding. Covering the frame are a back rest upholstery covering portion 92 and side arm covering portions 93, 94. The seat includes a seat deck 95, which may include frame members 96 and metal springs 97; a recliner mechanism 99 is positioned below the seat deck.

Although in FIGS. 1B and 1D, the back rest upholstery portions, the arm rest upholstery portions, and the base upholstery portions (in the sofa) are depicted as separate upholstery components to be attached to the sofa frame. In embodiments they may be combined in an integrated upholstery covering with the separate portions connecting prior to installation on the sofa or recliner frame. In embodiments, upholstery for the sofa and recliner may be furnished as a kit, the kit manufactured at a location remote from a final assembly location of the sofa. When used herein, "portion" may be all of or part of something. Portion is not to be considered as limiting.

Figure 2A:
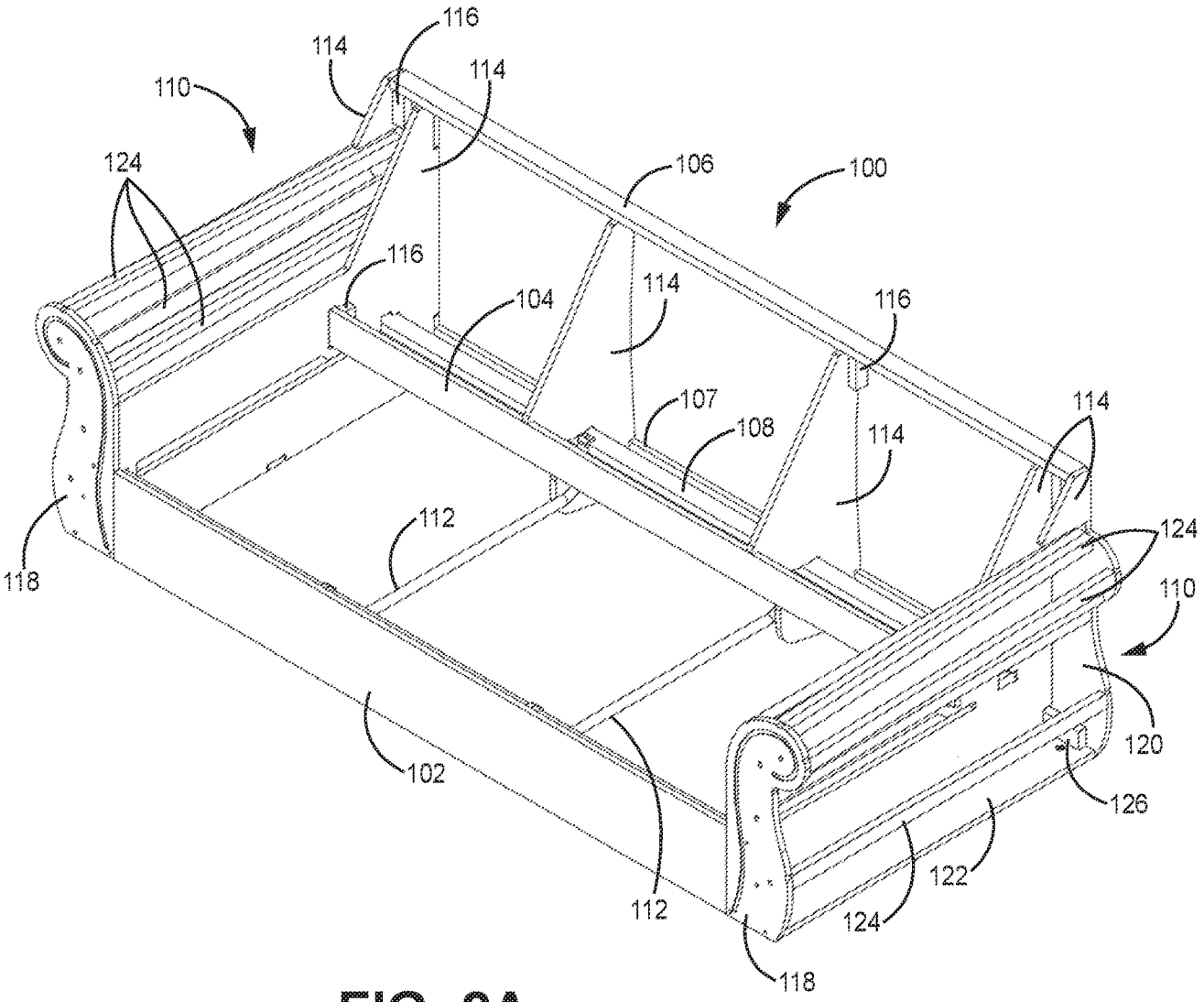
FIG. 2A PRIOR ART
FIG. 2A is a perspective view of a PRIOR ART sofa frame formed primarily from wood components.
Figure 2B:
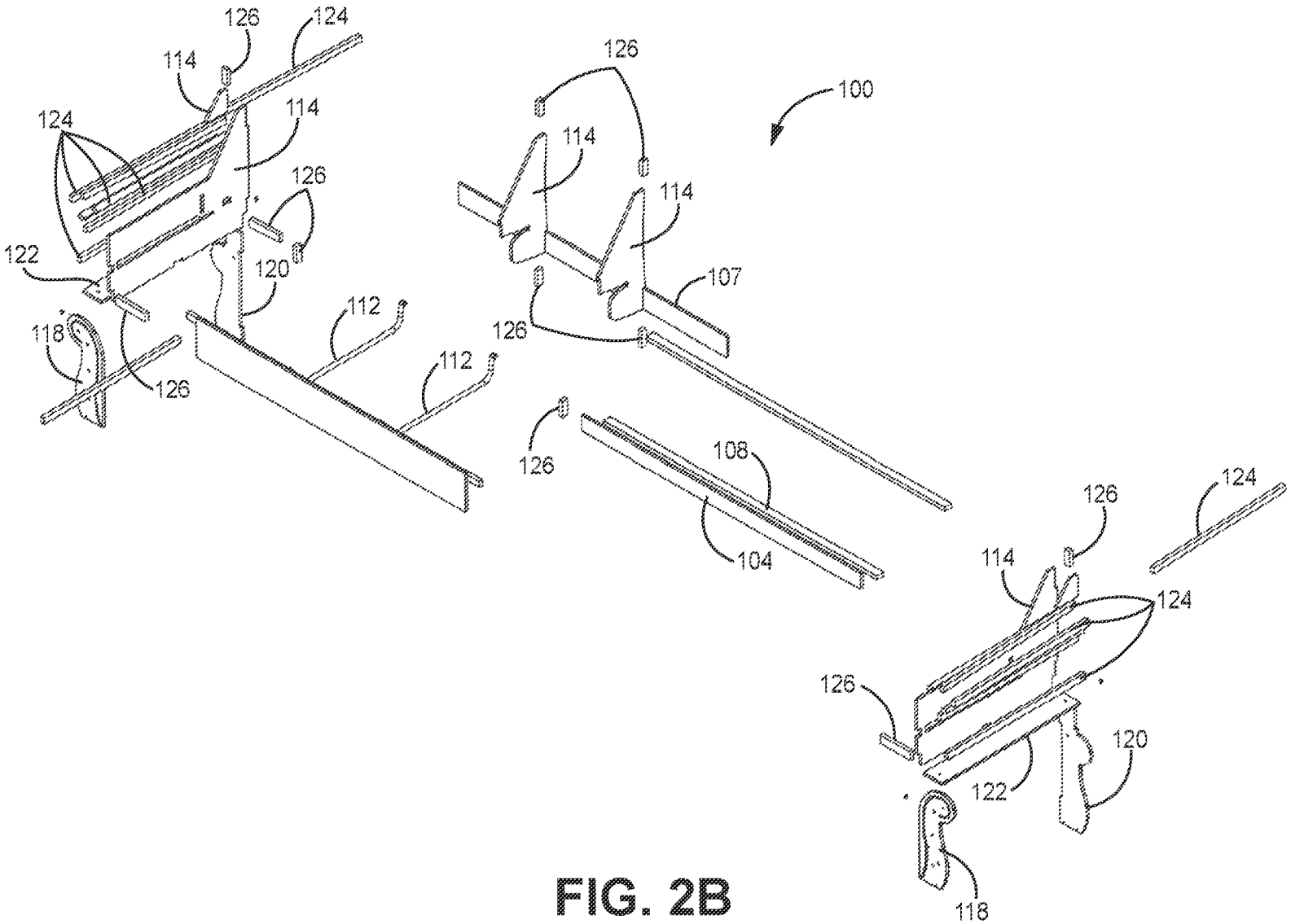
FIG. 2B PRIOR ART
FIG. 2B is an exploded view of the PRIOR ART sofa frame of FIG. 2A.

Referring to Prior Art FIGS. 2A and 2B, a wood structural frame 100 for a conventional sofa is depicted. Certain portions of frame 100 once assembled, such as arms portions, can be covered by cardboard or fiberboard for providing further shape and closing openings, and may be further covered with padding or cushioning, such as foam. Frame 100 can then be covered with fabric, leather, synthetic fabric, faux leather, microfiber, or other upholstery or covering materials. Such padding and covering materials are not depicted in FIGS. 1 and 2. As depicted, frame 100 includes dozens of different parts. These parts can include, for example, one or more front rails 102 (which can be made of oriented strand board or "OSB") forming a front of sofa frame 100, one or more rear or back rails, such as breast rail 104 (which can be made of oriented strand board or "OSB"), top back rail 106 (which can be made of hardwood or "HW"), lower back rail 107 and spring rail 108 (which can be made of hardwood or "HW"), forming a back of sofa frame 100. Frame 100 front and back portions can be connected by two arms 110 and one or more seat stretchers 112 (which can be made of metal). The back of frame 100 can further include one or more uprights 114 (which can be made of oriented strand board or "OSB") also forming a back of sofa frame 100. Frame 100 can include a plurality of tie blocks 116 (which can be made of hardwood or "HW") for connecting the components of frame 100 together and maintaining the proper positioning and angles of frame 100. The many wood components need to be precisely shaped by sawing or milling and are typically connected with fasteners, such as staples, and sometimes with adhesives.

Each of the prior art arm rest frames 110 can include a number of components, including a front post 118 and a back post 120 (which can be made of oriented strand board or "OSB") providing a shape to arms 110 connected by one or more leg rails 122 (which can be made of oriented strand board or "OSB") and one or more arm pulls 124 (which can be made of hardwood or "HW"). Each of the arm frames 110 can include one or more tie blocks 126 (which can be made of hardwood or "HW") for connecting the components of the arm together and maintaining the positioning and angles of arms 110. As depicted, each of arms 110 of sofa frame 100 includes up to or even over 10 or 15 parts that are connected with a multitude of fasteners such as staples.

Referring to FIGS. 3A to 4A, the structural frame 60 according to embodiments of the present disclosure, include the two molded polymer components, specifically, the two arm rest forms 68, 69. Frame 60, once assembled, can be covered by padding or cushioning, such as load poly, arm fiber, and/or foam, and can then covered with fabric, leather, synthetic fabric, faux leather, microfiber, or other upholstery or covering materials (including arms 210, depicted with covering materials in FIGS. 12-13).

As depicted, frame 60 can include one or more spanning wood frame members 201 which may be configured as front rails 202 (which can be made of oriented strand board or "OSB") forming a front portion of frame 60, one or more rear or lower back rails 203, breast rail 204 (which can be made of oriented strand board or "OSB"), top back rail 206 (which can be made of hardwood or "HW"), and spring rail 208 (which can be made of hardwood or "HW") forming a back portion of frame 60. Spanning wood frame members 201 front and back are received in recesses 207 defined in the wall portions of the two arm rest forms 210. The recesses 207 capture, restrain and positionally fix the ends 201.2 of the spanning wood frame members 201. Differently configured recesses 207 are illustrated in the arm rest forms of FIGS. 5-11. Many of the recesses are defined by wall portions including an upwardly facing surfaces 207.3 that the spanning wood frame members seat on, see in particular FIGS. 9 and 10.

Figure 3A:
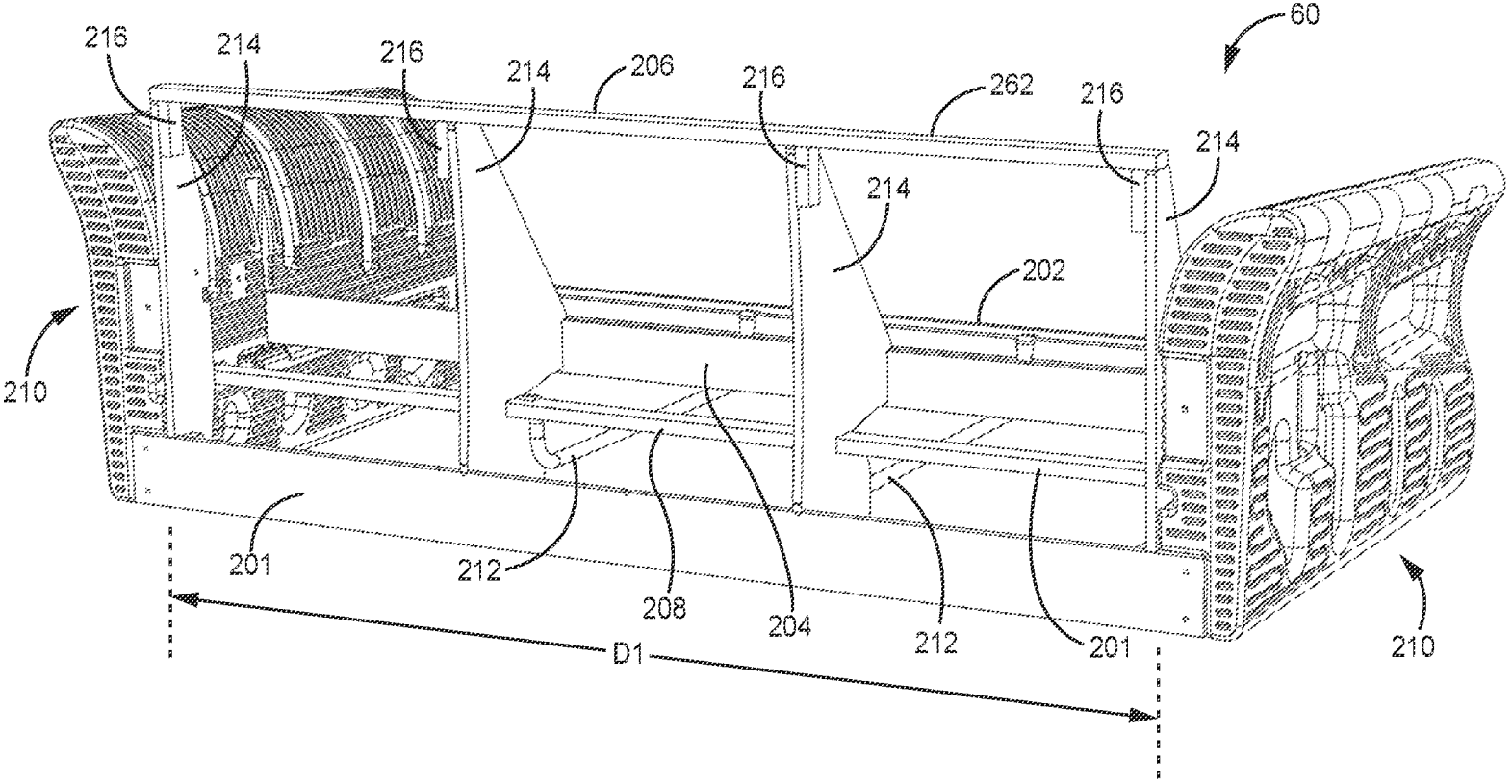
FIG. 3A is a perspective view of the rearward side of the sofa frame shown in FIG. 1B.
Figure 4A:
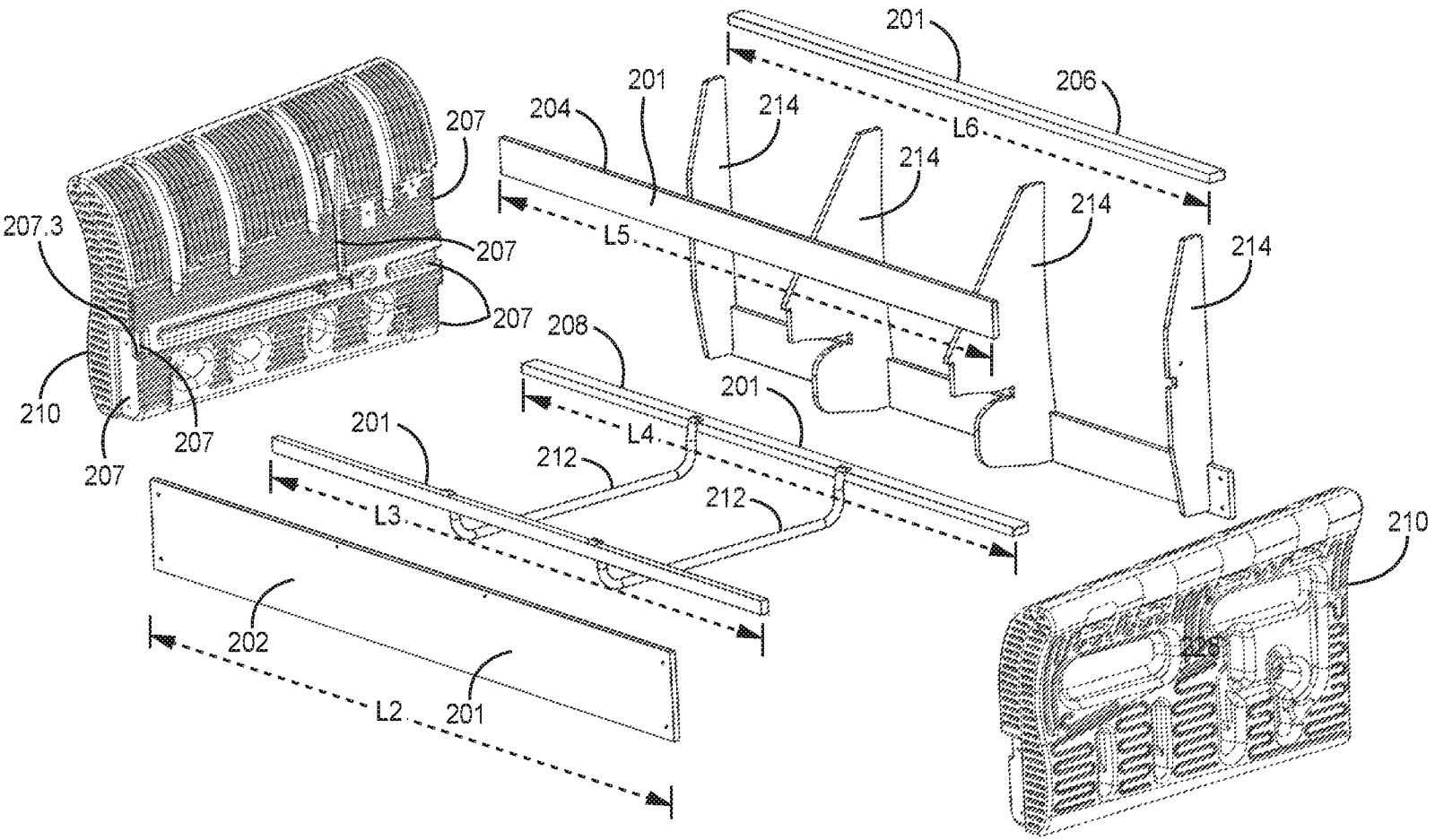
FIG. 4A is an exploded view of the sofa frame of FIGS. 3A and 3B.
Figure 4B:
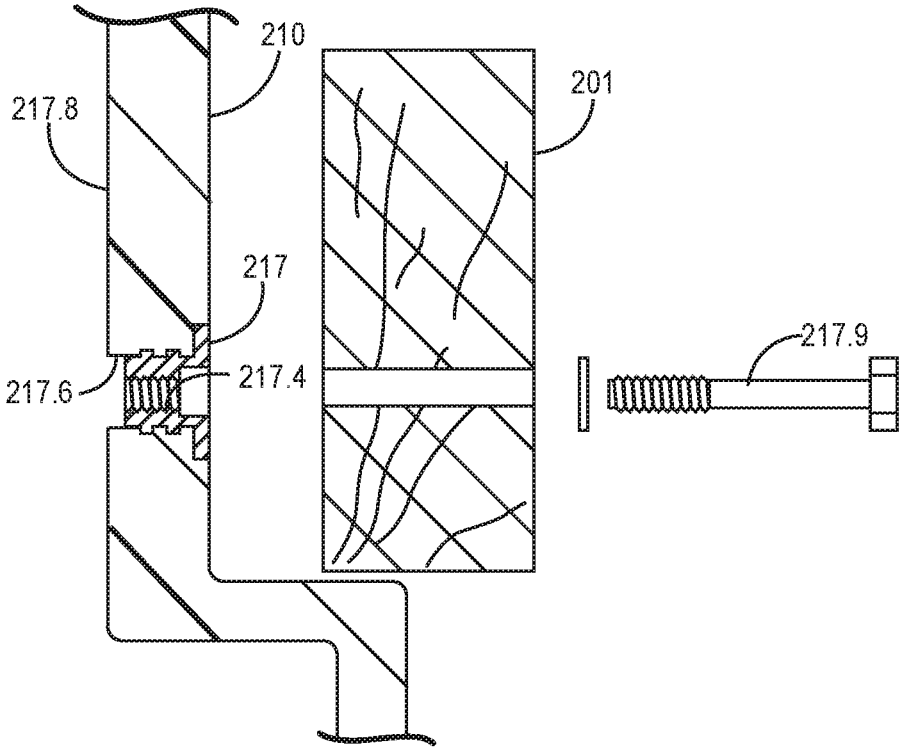
FIG. 4B is a cross sectional view of a wall portion of a molded arm rest form showing a recess for receiving a spanning wood frame member.

Referring to FIGS. 3A and 4A, the arm rest portions 210 are separated by a distance D1 and the spanning wood frame members have lengths L2, L3, L4, L5, L6 that are all greater than the arm rest separation distance D1. The spanning wood frame members may be unitary wood boards, including OSB and plywood.

The frame 60 may include one or more seat stretchers 212 (which can be made of metal). The back of frame 60 can further include one or more upright frame members 214 (which can be made of plywood or oriented strand board or "OSB") further forming a back portion of frame 60. Frame 60 can include one or more tie blocks 216 (which can be made of hardwood or "HW") for connecting the components of frame 60 together and maintaining the positioning and angles of frame 60.

Molded components, here, arm rest forms 210, can be connected to other components of sofa frame 60 depicted in FIGS. 3A to 4A with various fasteners, such as brackets, screws, clips, dowels, and other fasteners. Referring to FIG. 4B, a metal insert 217 having a threaded bore 217.4 may be driven into a hole 217.6 formed in the wall portion 217.8 of the blow molded arm rest form or other blow molded component. See U.S. Pat. Nos. 9,651,080 and 9,028,185, each of which are incorporated by reference herein. The metal threaded insert 217 may receive a bolt 217.9, such as, by way of example only, a ¼-20 bolt, to connect molded components to other components. Such connection can be between blow-molded components and other components made of materials such as, by way of example, hardwood, softwood, engineered woods, such as plywood, hardboard, millboard, chipboard, and fiberboard, metal, and plastics. Specifically the insert can securely attach the spanning wood frame members 201.

Arm rest forms 210 can be formed of by molding methods, such as blow molding (injection blow molding, extrusion blow molding, injection stretch blow molding), and formed of different materials including, by way of example, polyethylene (PE), such as high-density polyethylene (HDPE) and low-density polyethylene (LDPE), polyvinyl chloride (PVC), polypropylene (PP), nylon, and polyethylene terephthalate (PET), thermoplastic elastomers (TPE), acrylonitrile butadiene styrene (ABS), polyphenylene oxide (PPO), nylon/polyamids (PA), polycarbonate (PC), polyester and copolyester, urethane and polyurethane, and acrylic and polystyrene. In other embodiments, molded components can be formed by differing molding methods, such as injection molding (overmolding, insert molding, cold runner injection molding, hot runner molds, rotational molding).

In embodiments, a ballast material can be added to arms 210 to provide further stability and acoustical insulation to arms 210 and frame 60, generally. Such ballast material can include foam, such as a density foam, sand, cement, or other material. In embodiments, ballast can be added to arms 210 via a port or other opening in arm rest form (not depicted) that can include a cap or other closure structure that can be permanently or selectively closed.

Figure 3B:
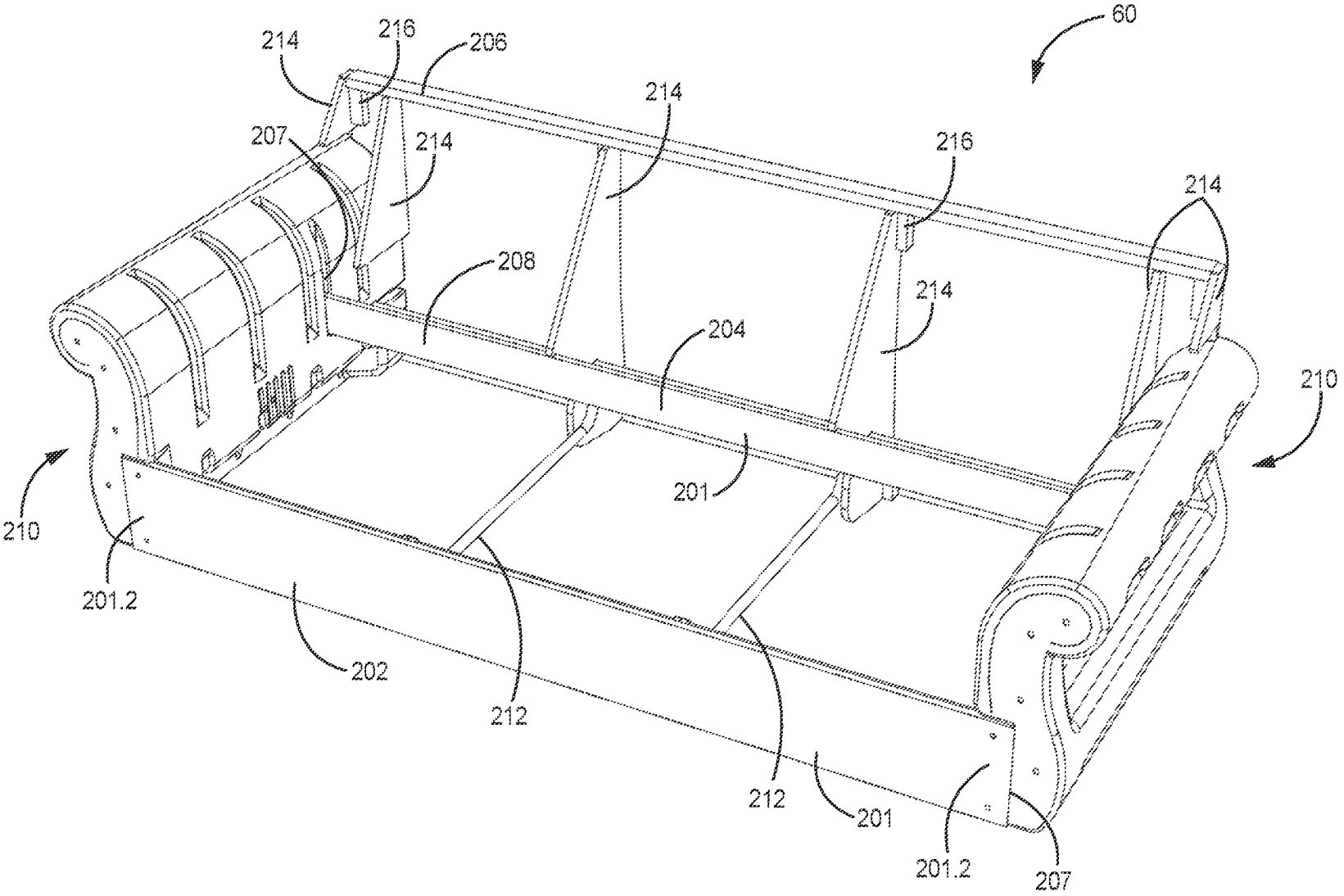
FIG. 3B is a front perspective view of another sofa frame according to embodiments.
Figure 3C:
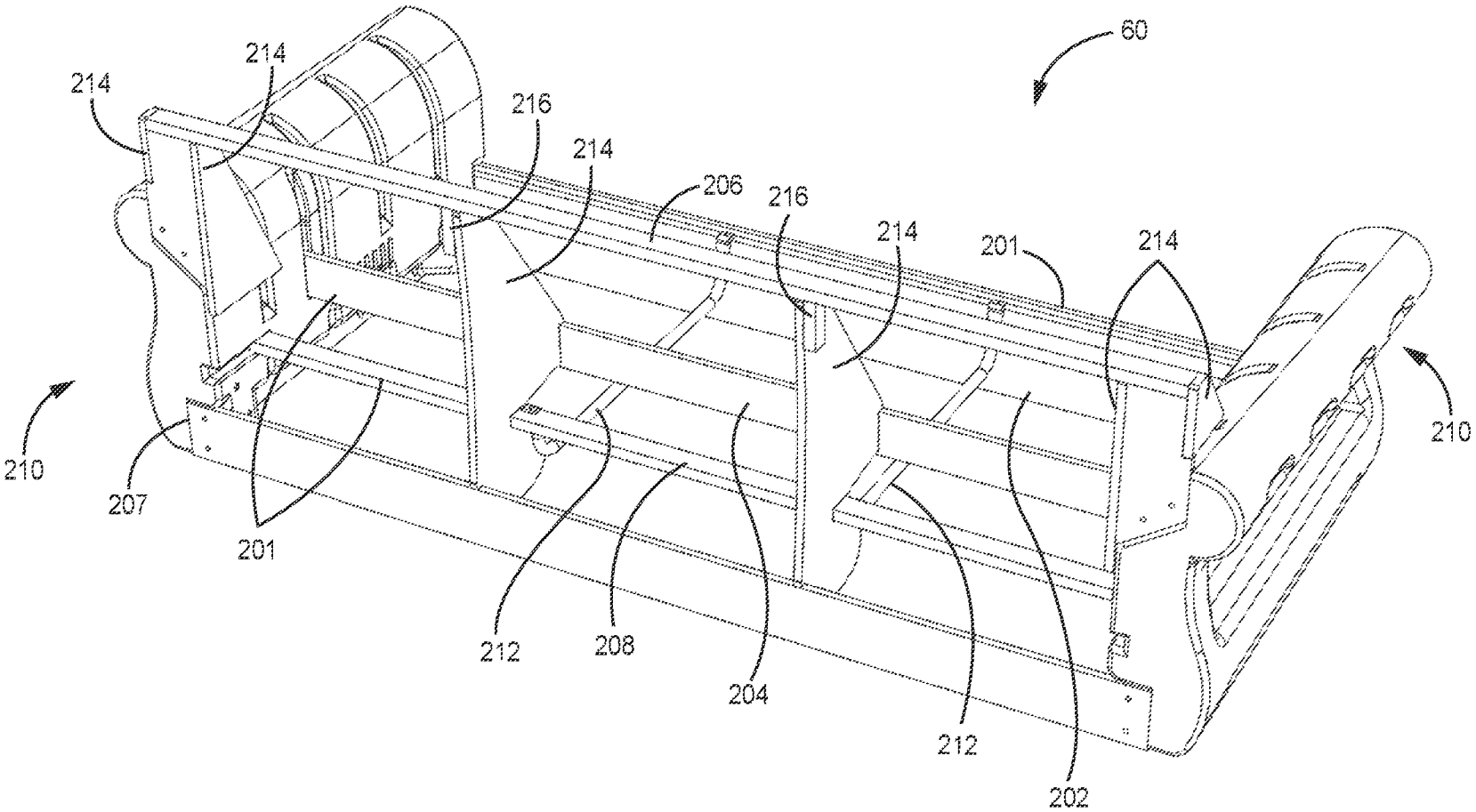
FIG. 3C is a rear perspective view of the sofa frame of FIG. 3B.

In embodiments, frame 60 depicted in FIGS. 3A to 4 can have up to and over 10 less parts, 20 less parts, or even greater than frame 100 depicted in FIGS. 1 and 2. Also, not only is the number of components that need to be assembled is minimized, but the frame is simpler to assemble and the time for assembly is minimized, in part due to there being less secondary operations. Also, with respect to shipping, the lighter weight reduces freight costs. Yet, frame 60 is robust, sturdy, and comfortable.

Figure 8:
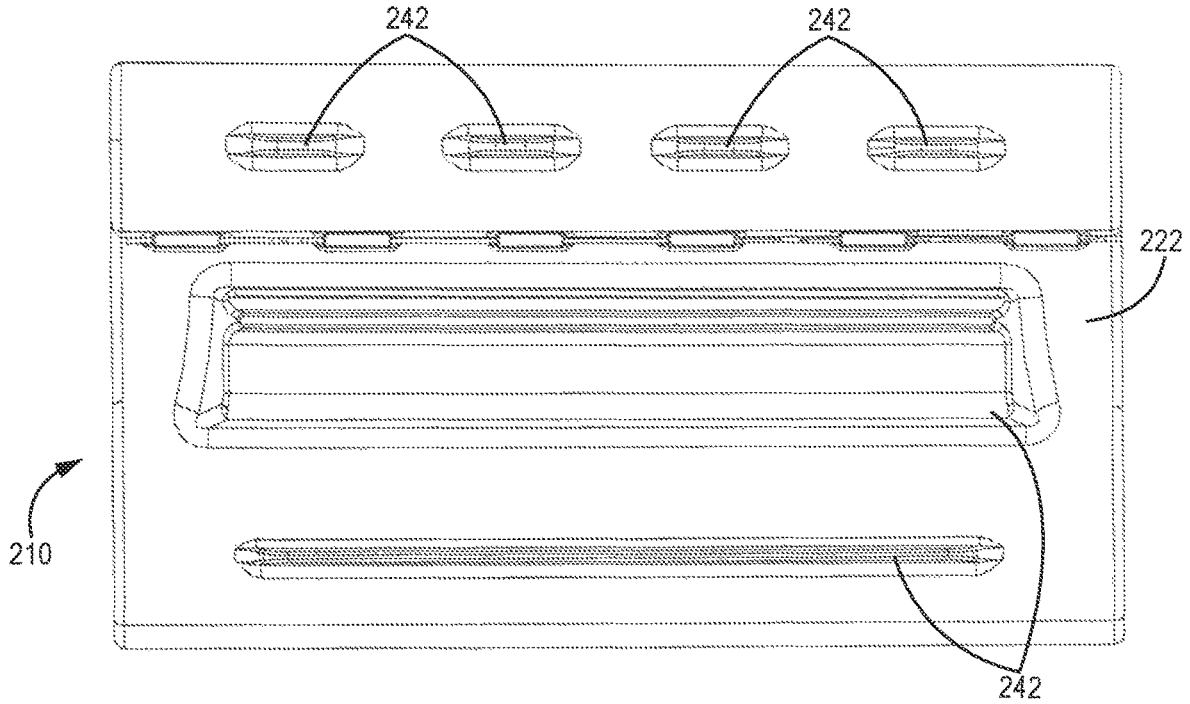
FIG. 8 is an outside elevation view of an arm rest form of the sofa frame of FIGS. 3B and 3C.
Figure 9:
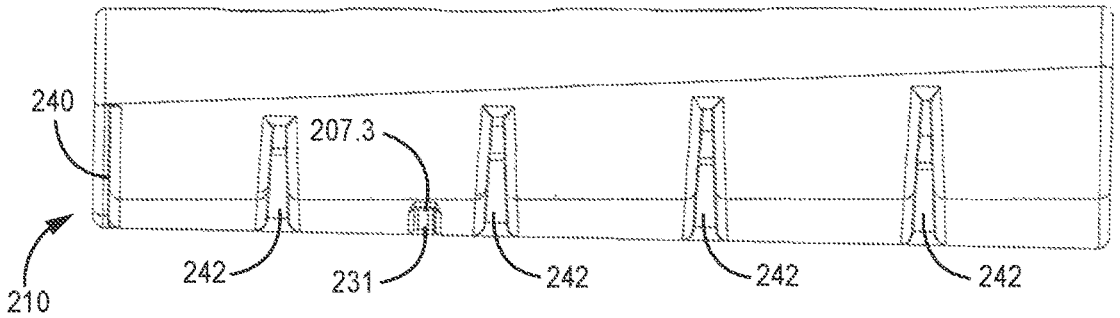
FIG. 9 is a top plan view of an arm rest form of the sofa frame of FIGS. 3B and 3C.
Figure 10:
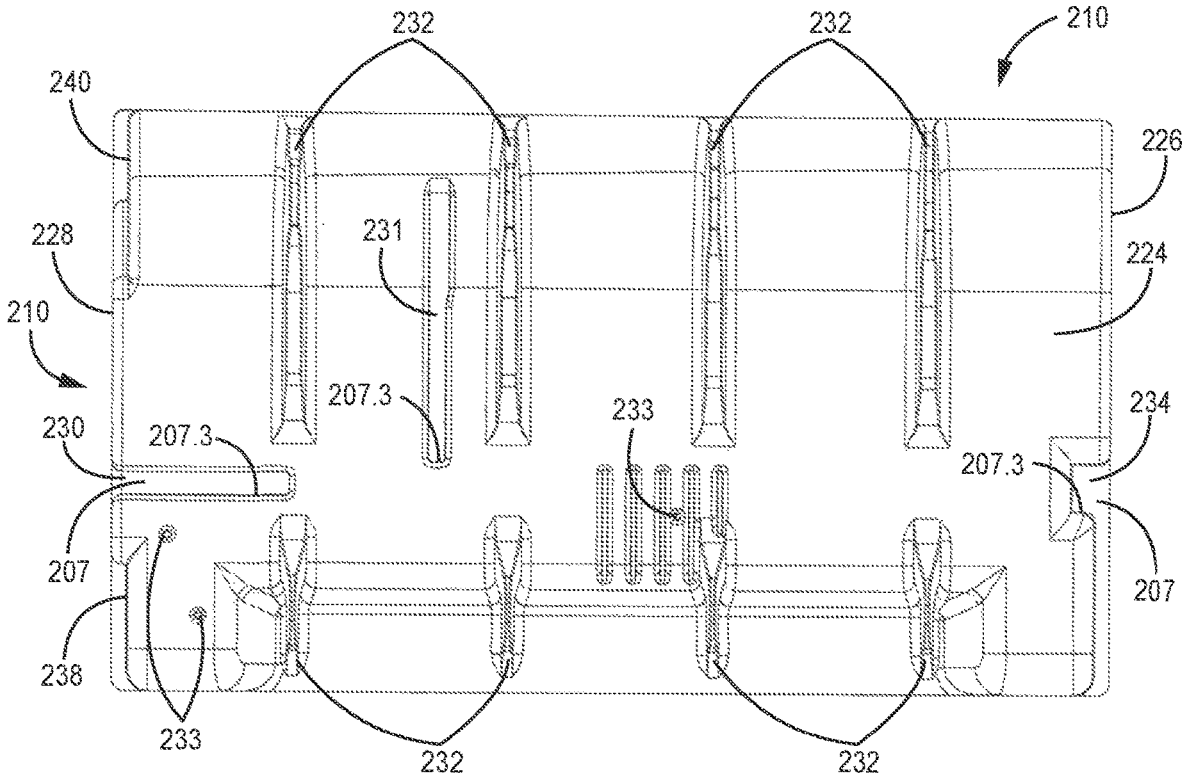
FIG. 10 is an inside elevation view of an arm rest form of the sofa frame of FIGS. 3B and 3C.
Figure 11:
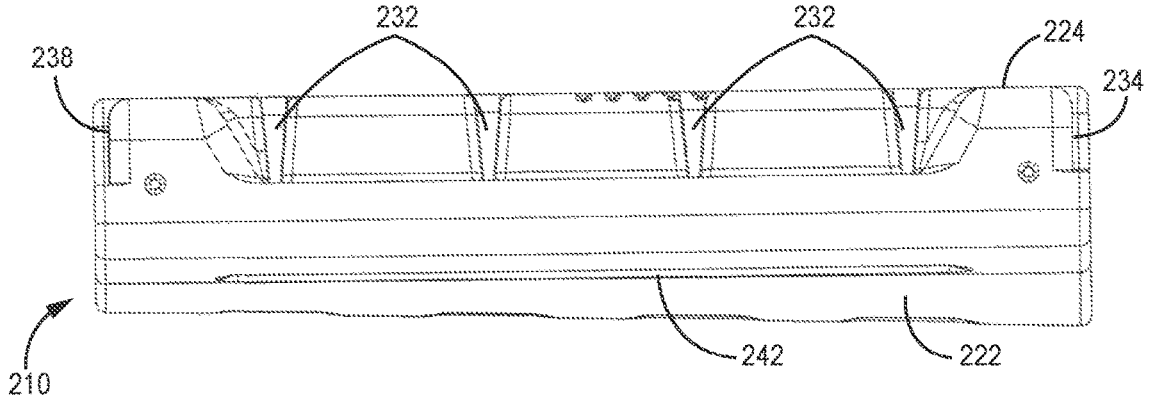
FIG. 11 is bottom plan view of an arm rest form of the sofa frame of FIGS. 3B and 3C.

Blow molded arm rest forms 210 are further depicted in FIGS. 5-11. Arm rest forms can be formed in any of a number of desired furniture arm shapes including, by way of example, track, ruched, modern scroll, pad, track with nails, key, modern English, shelter, pleated, and saddle. Arm rest forms can include a top 218, a bottom 220, an outside 222, an inside 224, a front 226, and a back 228. Referring to FIG. 10, inside wall portion 224 can include one or more recesses 207 or slots configured for one or more rails, such as, by way of example, spring rail slot 230 for receiving spring rail 208 and breast rail slot 231 for receiving breast rail 204. Inside wall portion 224 can further include one or more structural recesses 232 that can provide further structure, robustness, and sturdiness to sofa. Inside 224 can further include one or more apertures or openings 233 for use with metal insert threaded connectors for connecting arms to other components of furniture structure.

Figure 5:
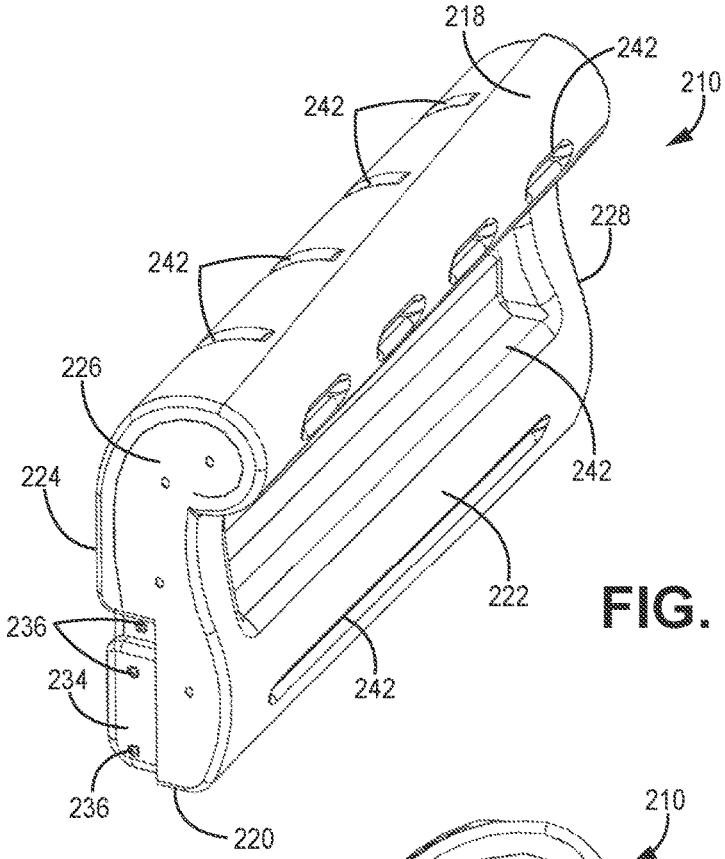
FIG. 5 is a front outer perspective view of an arm rest form of the sofa frame of FIGS. 3B and 3C.
Figure 6:
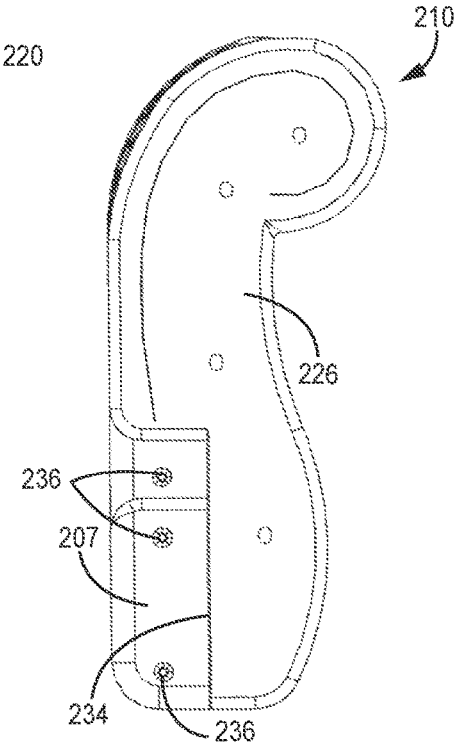
FIG. 6 is a front elevation view of an arm rest form of the sofa frame of FIGS. 3B and 3C.
Figure 7:
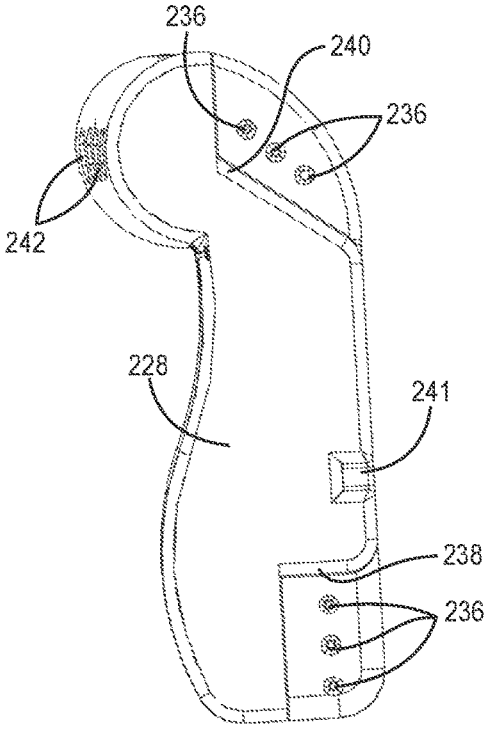
FIG. 7 is a rear elevation view of an arm rest form of the sofa frame of FIGS. 3B and 3C.

Referring to FIGS. 5 and 6, front wall portion 226 can include one or more recesses 207 configured for one or more rails, such as a front rail recess 234. Front wall portion 226 can further include one or more apertures or openings 236 for use with threaded metal inserts 217 for connecting arms to other components of furniture structure. Referring to FIG. 8, rear wall portion 228 can include one or more recesses configured for one or more rails or uprights, such as a bottom back rail recess 238, an upright recess 240, and a spring rail recess 241. Rear wall portion 228 can further include one or more apertures or openings 242 for use with connectors for connecting arm rest forms to other components of furniture structure. Outside wall portion 222 can further include one or more structural recesses 242 to provide further structure, robustness, and sturdiness to a sofa frame.

Figure 12:
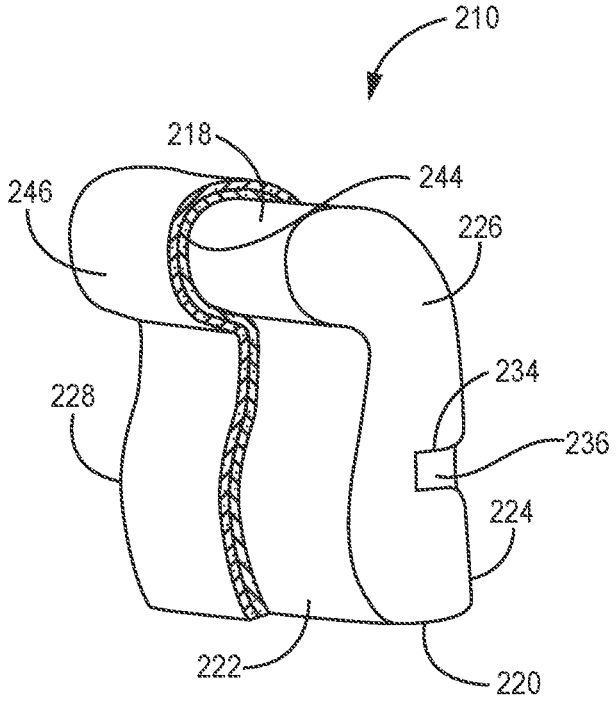
FIG. 12 is a front outer perspective view of an arm rest form of the sofa of FIG. 1A and the sofa frame of FIGS. 3B and 3C further comprising padding and cushion material.
Figure 13:
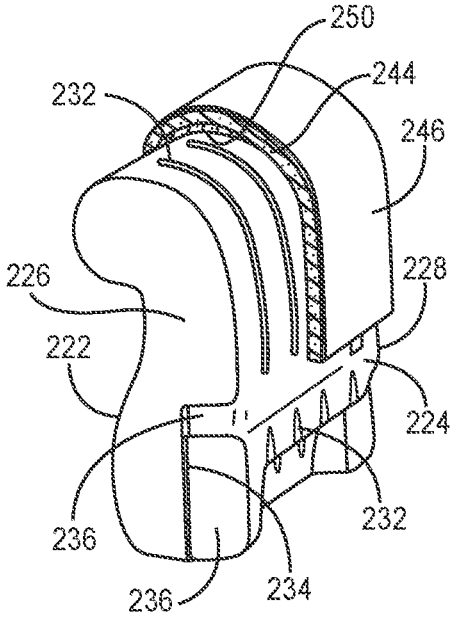
FIG. 13 is a front inner perspective view of another embodiment of the arm rest form of the sofa of FIG. 1A and the sofa frame of FIGS. 3B and 3C further comprising arm fiber and upholstery covering material.

Referring to FIGS. 12-13, arm rest forms can be covered by padding or cushioning, such as load poly, arm fiber, and/or foam, and can then covered with a covering material. In embodiments, such as depicted in FIG. 12, arm rest form 210 can be covered by arm fiber 244 and covering material 246. In another embodiment, depicted in FIG. 13, arm rest form 210 can be covered by load poly 250, arm fiber 244, and covering material 246. In embodiments, load poly 250 can comprise polyurethane foam. In embodiments, arm fiber 244 can comprise densified fiber. Covering material 246 can comprise fabric, leather, synthetic fabric, faux leather, microfiber, or other upholstery or covering materials.

Figure 14:
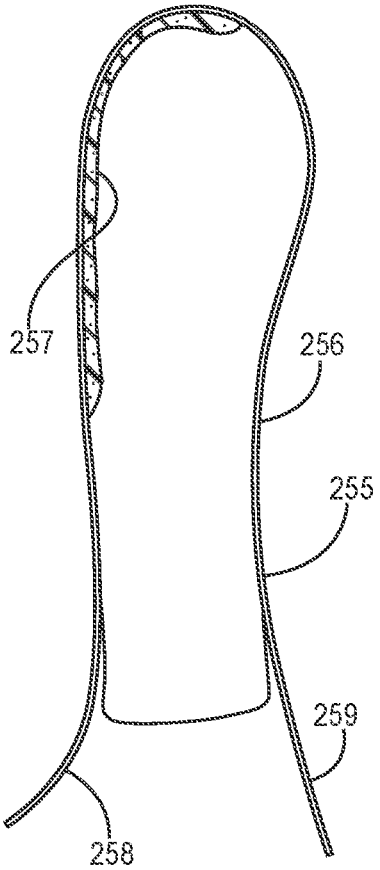
FIG. 14 is a cross section view of an upholstery sofa arm sock taken at line 14-14 of FIG. 1B.

Referring to FIGS. 1B and 14, a cross section of a upholstery portion 255 configured as an upholstery sock has a conforming shape to the arm rest form 68. Integrated on an inner surface of the upholstery material 256 is a layer of padding material 257. The upholstery portion with padding may be slid on the arm rest form without needing padding attached to the arm rest form beforehand. Upholstery panels 258, 259 may be attached to the bottom side of the sofa frame, for example to a bottom wall portion of the arm rest form by way of staples or other fasteners.

Figure 15A:
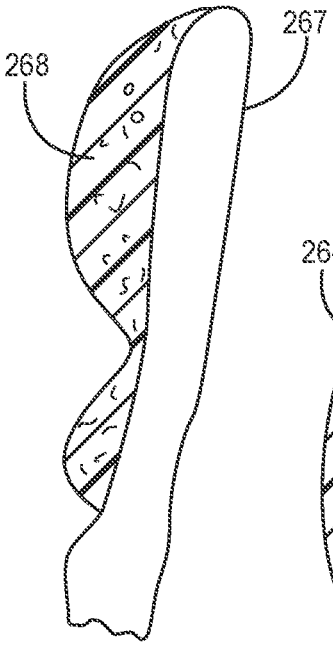
FIG. 15A is a cross section view of a back rest upholstery covering taken at line 15A-15A of FIG. 1B.
Figure 15B:
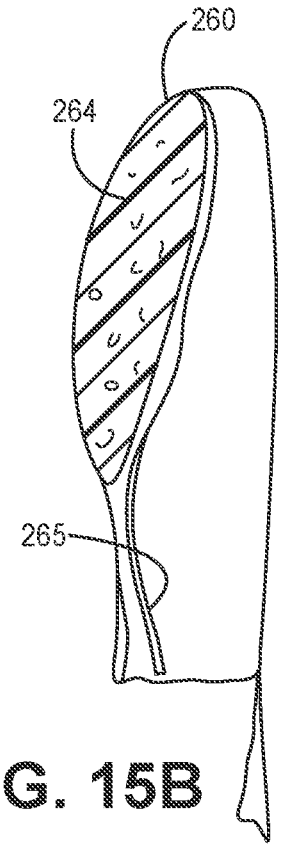
FIG. 15B is a cross section view of an recliner upholstery covering taken at line 15B-15B of FIG. 1D.

Referring to FIGS. 3A and 15B, a cross section of a back rest upholstery sack 260 that is form fit to the back rest frame 262 and that has cushion material 264 integrated therein as well as back rest support straps 265. See U.S. Pat. No. 10,299,606 for illustration of such straps and integrated cushioning material. Said patent is owned by the owner of this application and is incorporated by reference herein for all purposes.

Referring to FIGS. 1D and 15A, a back rest upholstery portion 267 configured as a upholstery sack with an integrated cushion material 268 may be form fit to the molded back rest form 404 and slid thereon easily due to a low coefficient of friction of the polymer back rest form and many upholstery materials. Fasteners such as staples may be used to secure the upholstery portion to the back rest form 404.

Figure 16:
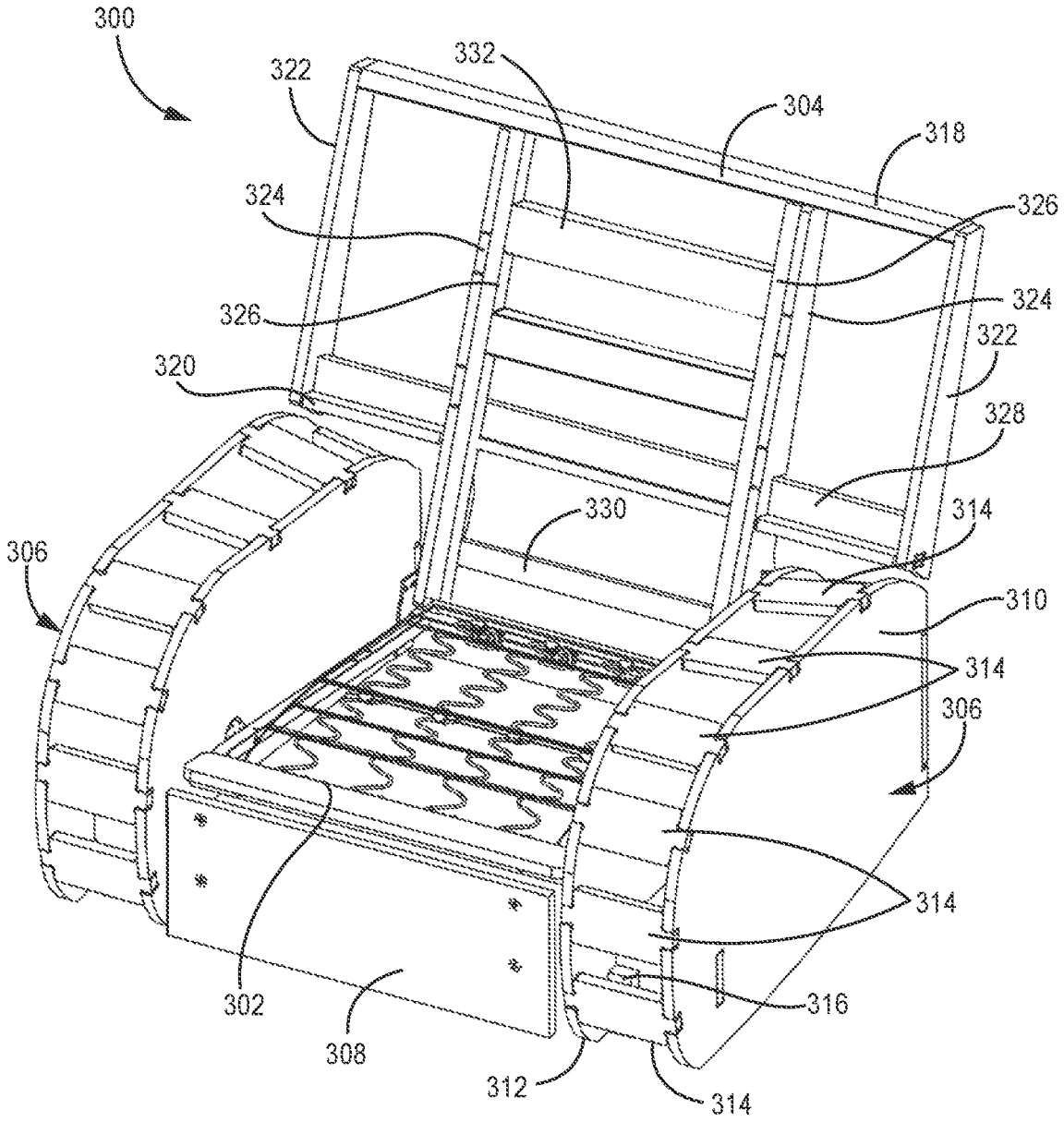
FIG. 16 PRIOR ART
FIG. 16 is a perspective view of a PRIOR ART recliner frame not including any molded plastic components.

Referring to FIG. 16, a prior art structural frame 300 for a recliner is depicted. Certain portions of frame 300 once assembled, such as arms portions, can be covered by cardboard or fiberboard for providing further shape and, further, can be covered by padding or cushioning, such as load poly, arm fiber, and/or foam, and can then covered with fabric, leather, synthetic fabric, faux leather, microfiber, or other upholstery or covering materials. As depicted, prior art chair frame 300 generally includes a seat box 302, a back rest form 304, two arms 306 and a footrest 308.

Each of prior art arm rest frames 306 can include a number of components, including outside arm rail 310, inside arm rail 312, and a plurality of arm fillers 314 connecting outside arm rail and inside arm rail. A plurality of tie blocks 316 can be included for connecting the components of the arm—only one being depicted in FIG. 16. Arm rest frame 306 can further include cardboard or fiberboard for providing further shape or support to arm (not depicted in FIG. 16). As depicted, each of arm rest frames can includes about 19 parts, not including fasteners. Typically a multitude of fasteners, such as staples and wood glue are utilized for assembling the arm rest frames.

Prior art backrest 304 can include a number of components, including a top back rail 318, a bottom back rail or wing mount 320, one or more wings 322, one or more back posts 324, one or more back post stiffeners 326, a back brace 328, a breast rail 330, and webbing 332. As depicted, backrest includes about 15 parts. A multitude of fasteners, such as staples are utilized for assembling the back rest.

Figure 17:
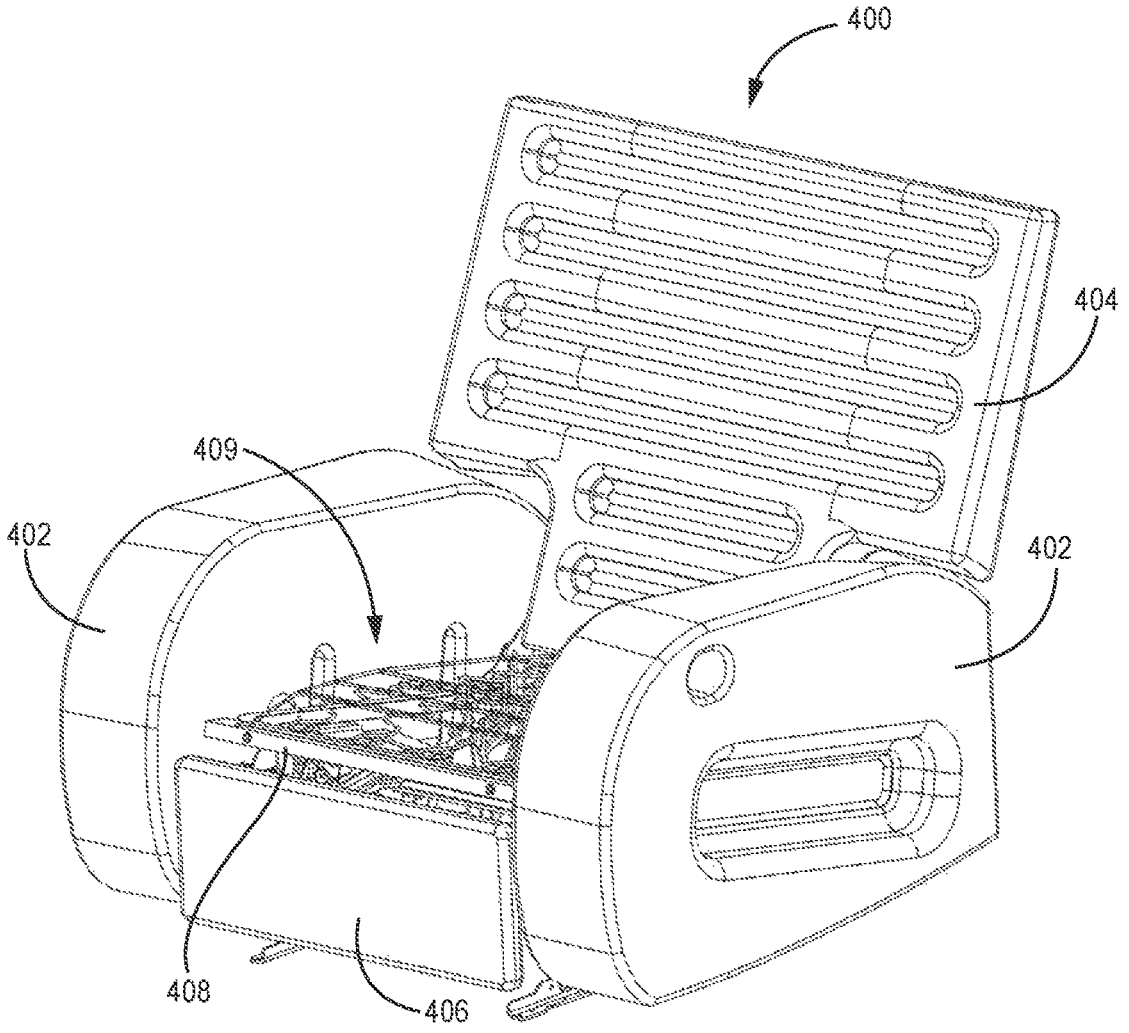
FIG. 17 is a perspective view of a recliner frame with a seat deck and recliner mechanism of a recliner such as shown in FIG. 1D according to embodiments including a molded backrest portion and two molded arm rest forms.
Figure 18A:
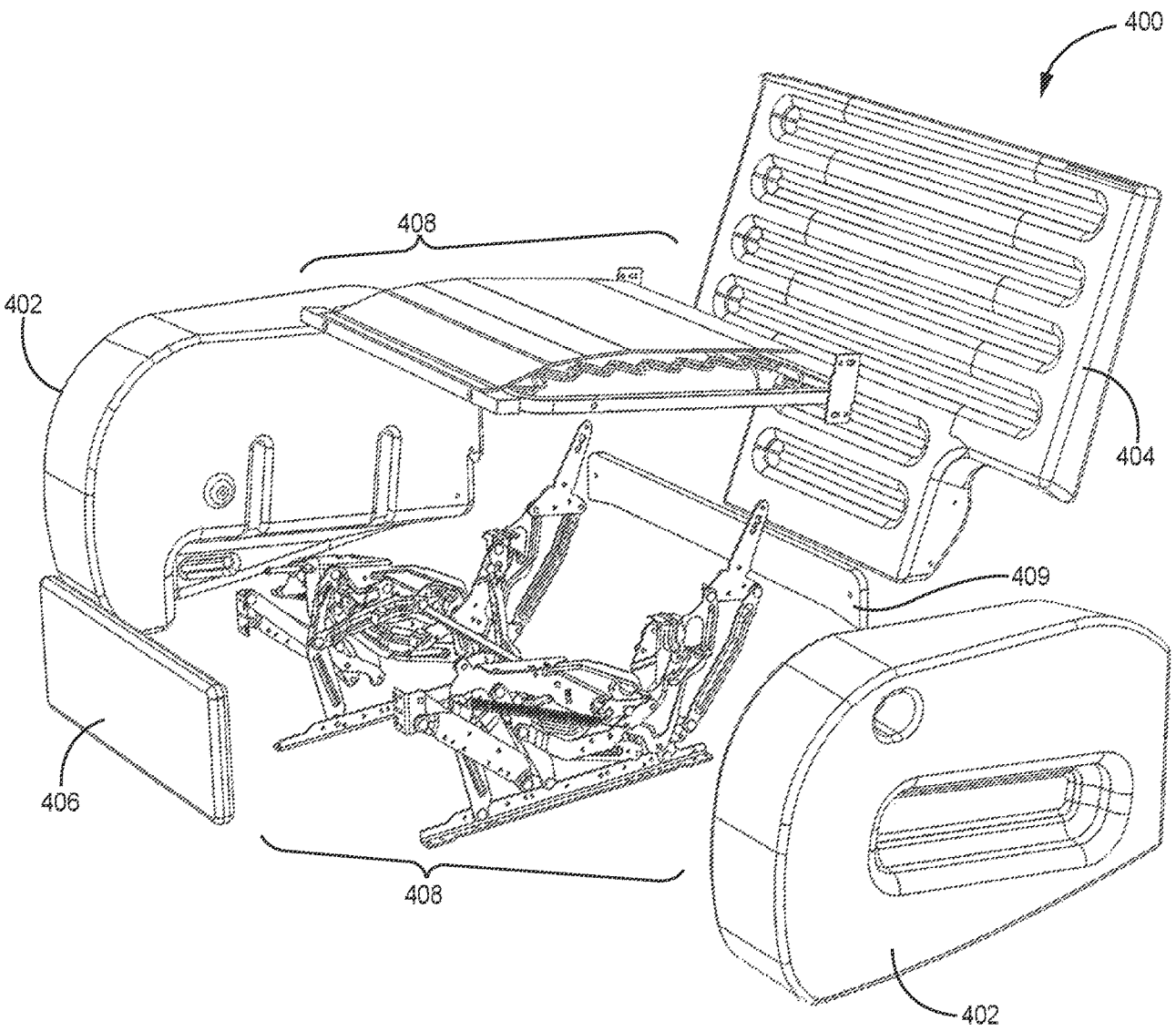
FIG. 18A is an exploded view of the recliner components of FIG. 17.
Figure 18B:
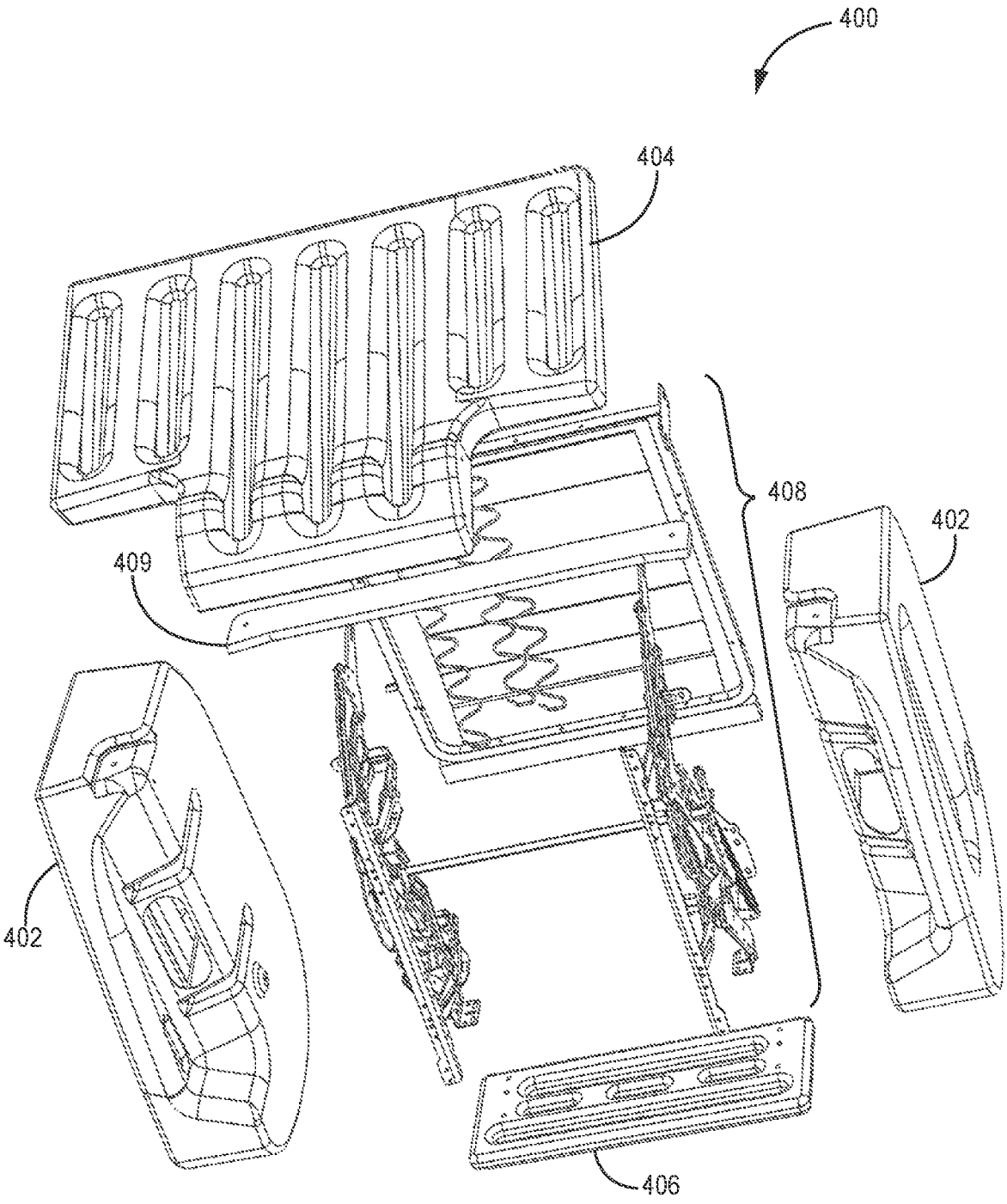
FIG. 18B is a rearward exploded view of the recliner of FIG. 17.

Referring to FIGS. 17 and 18, a chair frame 400 according to embodiments of the present disclosure, specifically a frame for a recliner, including four molded components (specifically, two arms 402, a backrest 404, and a footrest or ottoman 406) is depicted. Frame 400 further includes a reclining mechanism 408 for reclining function and a back rail 409. As depicted in FIGS. 1C and 1D, recliner frame 400, once assembled, can be covered by padding or cushioning, such as load poly, arm fiber, and/or foam, and can then covered with fabric, leather, synthetic fabric, faux leather, microfiber, or other upholstery or covering materials. Fasteners such as staples may be used for attaching covering materials to molded components.

Figure 19:
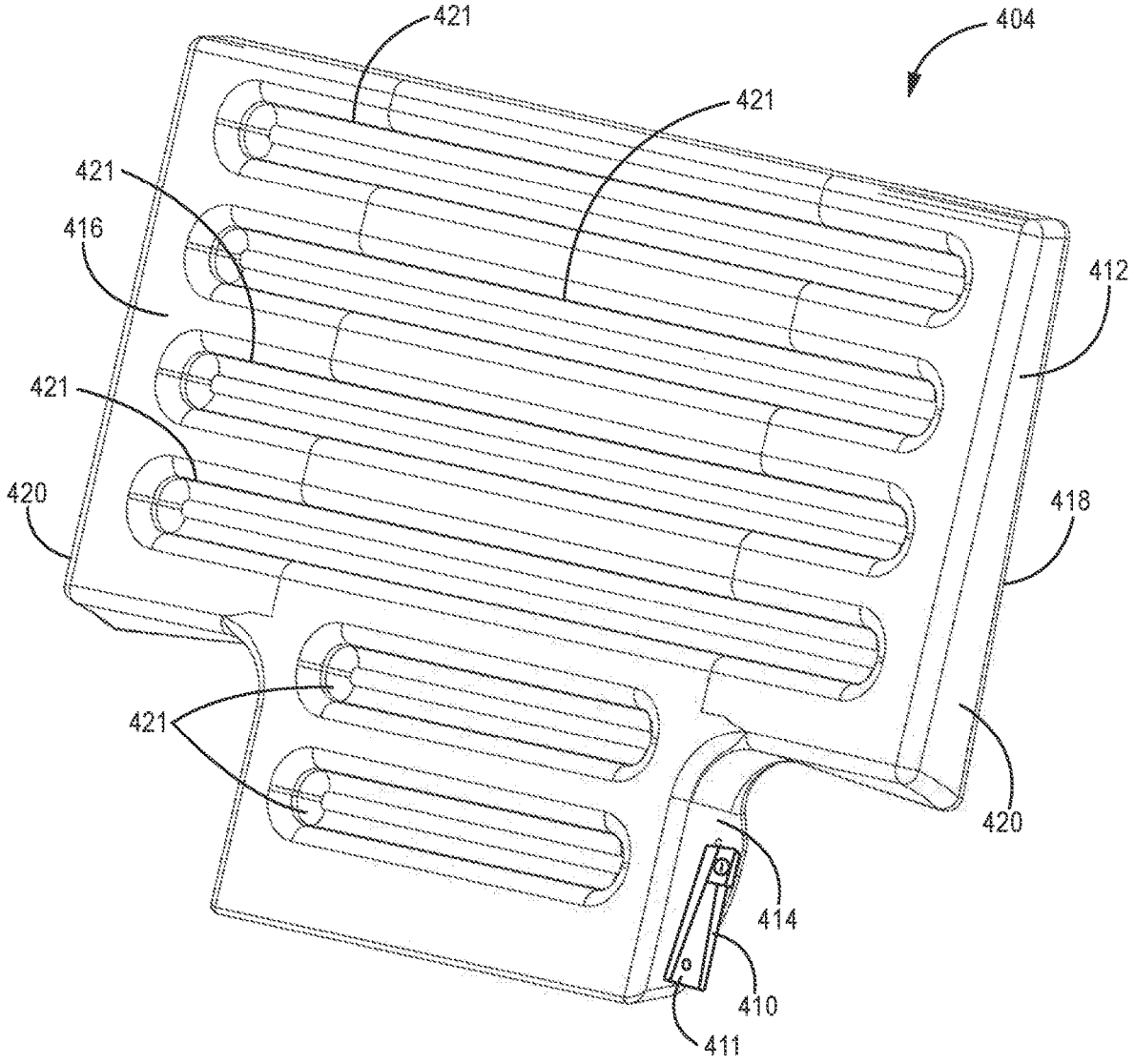
FIG. 19 is a front perspective view of a backrest portion according to an embodiment of the present disclosure.
Figure 22:
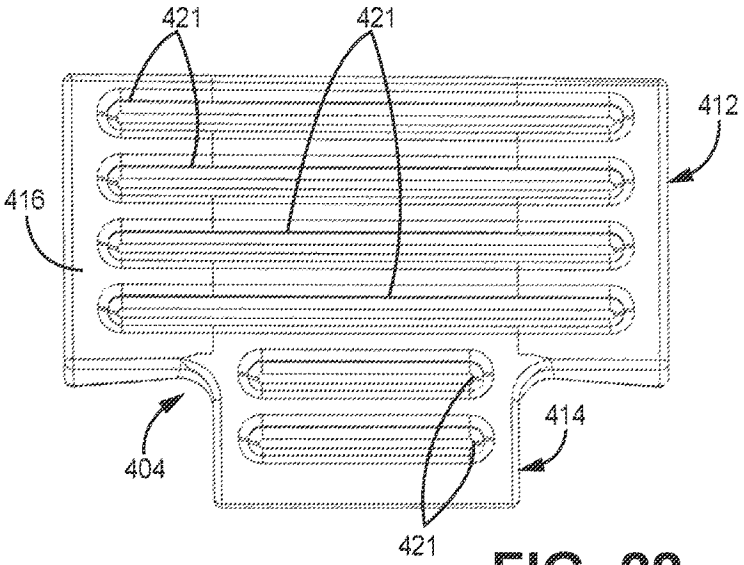
FIG. 22 is a rear elevation view of a backrest form of the chair frame of FIG. 19.
Figure 23:
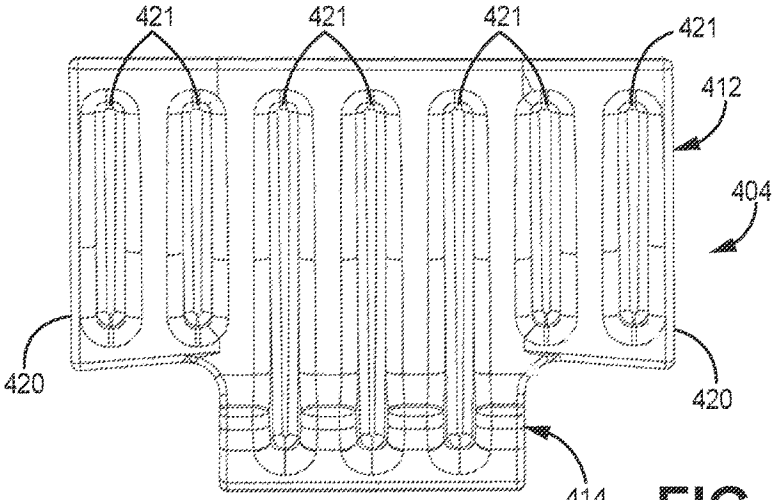
FIG. 23 is a front elevation view of a backrest form of the chair frame of FIG. 19.
Figure 20:
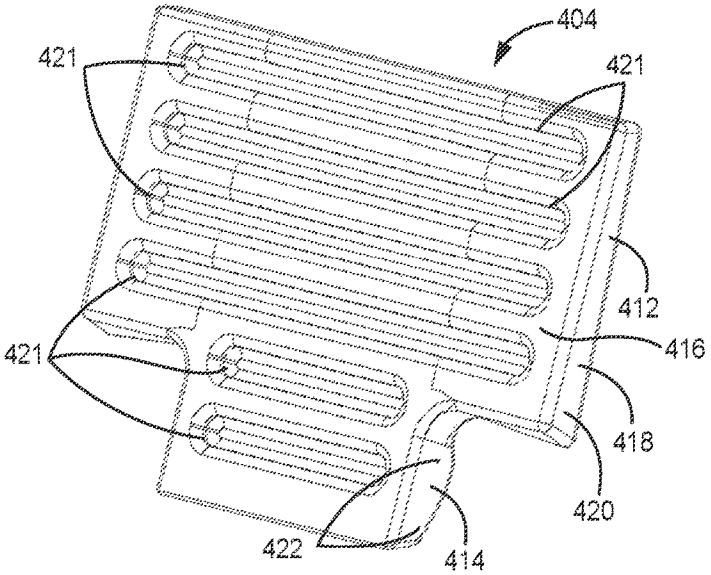
FIG. 20 is a front perspective view of a backrest form of the chair frame of FIG. 19.
Figure 21:
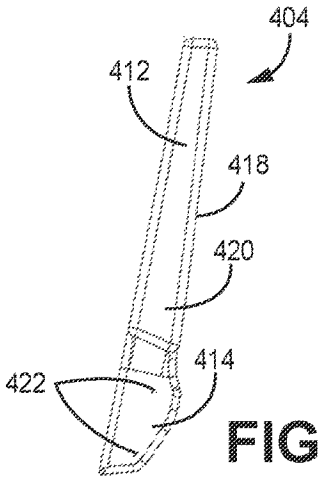
FIG. 21 is a right side elevation view of a backrest form of the chair frame of FIG. 19.

Molded components, here, arm rest forms 402, back rest form 404, and footrest 406 can be connected to other components of frame 400 with various fasteners, such as brackets, screws, clips, dowels, and other fasteners. Back rest form 404 can also be attached to frame 400 via a steel bracket 410, with a recess 411 such as depicted in FIG. 19. Apertures or openings in molded components (described below) can include the insert 217, shown in FIG. 4B, in which a bolt, such as, by way of example only, a ¼-20 bolt, can be threaded to connect molded components to other components, such as the seat deck and the recliner mechanism.

Molded components can be formed of by molding methods, such as blow molding (injection blow molding, extrusion blow molding, injection stretch blow molding), and formed of different materials including, by way of example, polyethylene (PE), such as high-density polyethylene (HDPE) and low-density polyethylene (LDPE), polyvinyl chloride (PVC), polypropylene (PP), nylon, and polyethylene terephthalate (PET), thermoplastic elastomers (TPE), acrylonitrile butadiene styrene (ABS), polyphenylene oxide (PPO), nylon/polyamids (PA), polycarbonate (PC), polyester and copolyester, urethane and polyurethane, and acrylic and polystyrene. In other embodiments, molded components can be formed by differing molding methods, such as injection molding (overmolding, insert molding, cold runner injection molding, hot runner molds, rotational molding).

In embodiments, a ballast material can be added to arms 402 to provide further stability to arms 402 or chair frame 400, generally. Such ballast material can include foam, such as a density foam, sand, cement, or other material. In embodiments, ballast can be added to arms via a port or other opening in arm 402 that can include a cap or other closure structure that can be permanently or selectively closed.

Back rest form 404 is further depicted in FIGS. 19-23. Back rest form 404 comprises a top portion 412 and a bottom portion 414 extending therefrom. Back rest form 404 further comprises a front wall portion 416, a back wall portion 418, and side wall portions 420. Front wall portion 416 and back wall portion 418 can include one or more structural recesses 421 to provide further structure, robustness, and sturdiness to sofa. Side wall portions 420 can include one or more apertures or openings 422 for use with connectors for connecting back rest form to other components of furniture structure. In embodiments, such as depicted in FIG. 19, back rest form includes bracket 410 for operably coupling back rest form 404 to another portion of frame 400, such as reclining mechanism 408 and/or arms 402. Bracket 410 can be connected to back rest form via apertures 422. Back rest form 404, or portions thereof, can be covered by padding or cushioning, such as load poly, arm fiber, and/or foam, and can then covered with fabric, leather, synthetic fabric, faux leather, microfiber, or other upholstery or covering materials.

Figure 26:
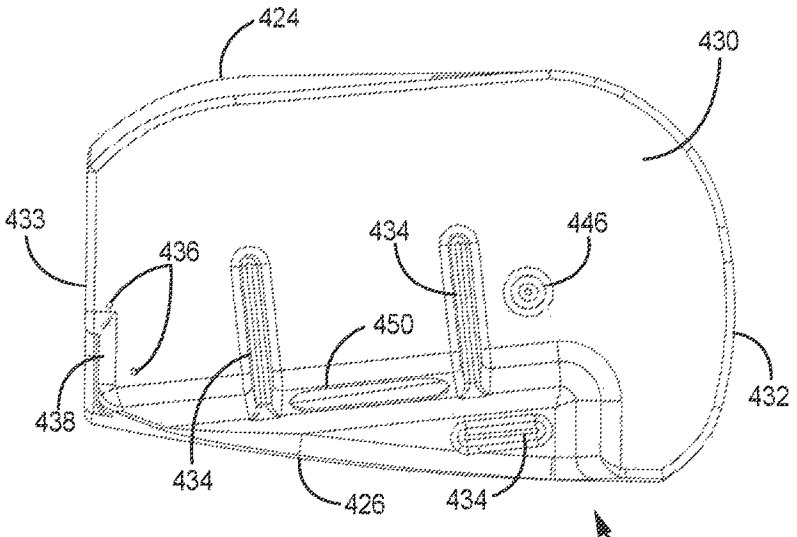
FIG. 26 is an inside elevation view of an arm rest form of the chair frame of FIG. 17.
Figure 27:
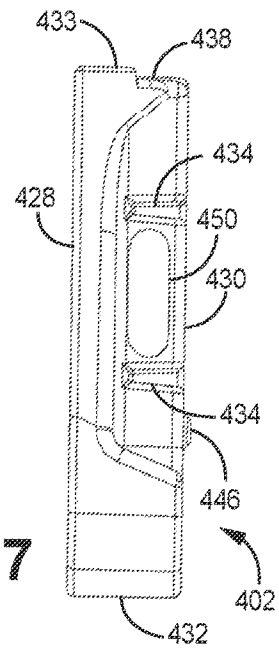
FIG. 27 is bottom plan view of an arm rest form of the sofa frame of FIG. 17.
Figure 25:
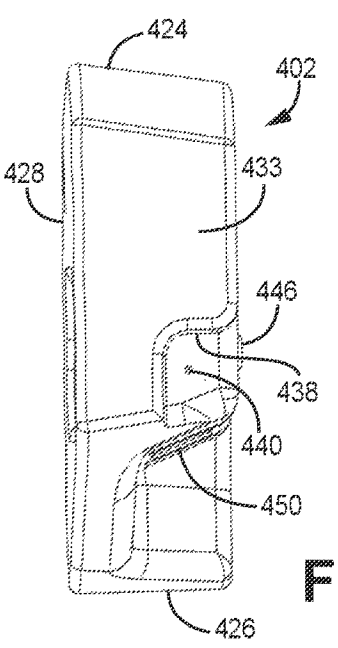
FIG. 25 is a rear elevation view of an arm rest form of the chair frame of FIG. 17.
Figure 24:
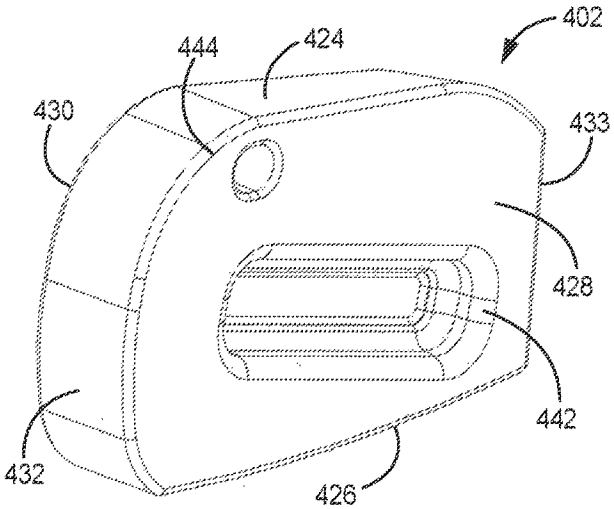
FIG. 24 is a front outer perspective view of an arm rest form of the chair frame of FIG. 17.

Arm rest forms 402 are further depicted in FIGS. 24-27. Arm rest forms can be formed in any furniture arm shapes including, by way of example, track, ruched, modern scroll, pad, track with nails, key, modern English, shelter, pleated, and saddle. Arm rest forms 402 can include a top 424, a bottom 426, an outside 428, an inside 430, a front 432, and a back 433. Referring to FIG. 26, inside 430 can include one or more recesses or slots 434 configured for connection with reclining mechanism 408 or a portion of a seat box. Inside 430 can further include one or more apertures or openings 436 for use with connectors for connecting arms 402 to other components of furniture structure and a projection 446 including an apertures or opening 436 for connecting arms 402 to other components of furniture structure, such as reclining mechanism 408. Referring to FIGS. 25 and 26, rear 433 can further include one or more recesses or slots 438 configured for connection with back rail 409 and one or more apertures or openings 440 for use with connectors for connecting arms to other components of furniture structure. Referring to FIG. 24, outside wall portions 428 can include one or more structural recesses 442 to provide further structure, robustness, and sturdiness to chair frame 400 and an opening 444 for coupling a portion of reclining mechanism 408 thereto—by way of example, a handle or lever (not depicted) for operating reclining mechanism 408. Referring to FIG. 27, bottom wall portion 426 can include an aperture or opening 450. Arm rest forms 402 or portions thereof can be covered by padding or cushioning, such as load poly, arm fiber, and/or foam, and can then covered with fabric, leather, synthetic fabric, faux leather, microfiber, or other upholstery or covering materials.

Figure 28:
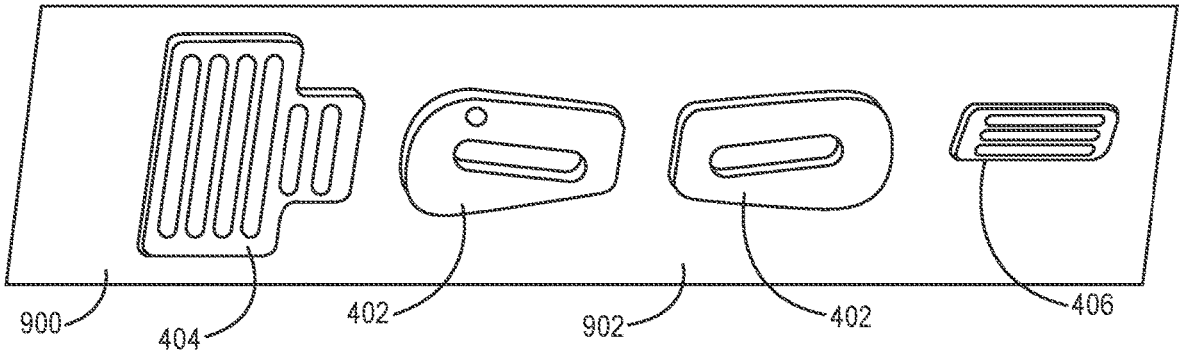
FIG. 28 is a perspective view of a single mold of the four molded components of the chair frame of FIG. 17, including the molded backrest portion, molded foot rest, and two molded arms.

Referring to FIG. 28, a single mold 900 of the four molded components of chair frame 400 of FIG. 17, including molded back rest form 404, molded foot rest 406, and two molded arm rest forms 402 is depicted. Once the mold is complete, the flashing 902 would be trimmed and any secondary operations would be performed. Processing time for molded back rest form 404, molded foot rest 406, and two molded arm rest forms 402 would be less than about five minutes, preferably less than about three minutes, and optimally less than one or two minutes. Advantageously, use of polyethylenes for the blow molded components allow use of reground drums which is environmentally and economically advantageous.

Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," should not be interpreted to limit the scope of the invention recited in the attached claims.

The following United States patents are hereby incorporated by reference herein: U.S. Pat. Nos. 7,070,243, 6,854,806, 6,702,391, 6,679,558, 5,582,460, 5,755,489, 5,575,533, 4,775,187, 3,877,087, 3,669,495, 3,658,382, 10,299,606, 10,117,521, 10,034,554, 9,839,295, 9,474,381, 8,777,319, 8,448,314, 8,438,716, 7,988,236, 7,806,482, and 7,438,362. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A method of assembling an upholstered sofa comprising:

blowmolding a pair of unitary, polymeric arm rest forms, each of the arm rest forms being hollow;

attaching a back rest frame and a seat base to the pair of polymeric arm rest forms by way of a plurality of spanning wood frame members, wherein attaching the back rest frame and seat base includes inserting ends of the plurality of spanning wood frame members (201) into recesses defined in the respective arm rest forms and securing the ends to the respective arm rest forms wherein the pair of polymeric arm rest forms are at a separation distance and wherein each of the spanning wood frame members has a length greater than the separation distance;

providing a plurality of upholstery portions form fit for each of the pair of arm rest forms and the back rest frame; and attaching the upholstery portions to the pair of arm rest forms and the back rest frame.

2. The method of claim 1, wherein the spanning wood frame members include a lower front rail and a lower back rail and the method further comprises mounting the lower front rail to a recess defined in each of the respective arm rest forms at a lower front margin of each of the arm rest forms and mounting the lower back rail to a recess defined in each of the respective arm rest forms at a lower back margin of each polymer arm rest form.

3. The method of claim 2, further comprising installing a seating platform having a forward spring board and a rear spring board and one of metal springs and a textile deck extending forwardly and rearwardly between the forward spring board and rear spring board by securing the forward spring board along its length to the front rail and securing the rear spring board to the lower back rail through at least two upright back rest frame members that extend from the lower margin of the back rail and an inside surface of the back rail to a top of the back rest.

4. The method of claim 3, wherein the forward spring board and rear spring board each have two ends and the method further comprises inserting each of the two ends of the forward spring board and rear spring board into corresponding form fit recesses in each of the pair of arm rest forms.

5. The method of claim 2, wherein the method further comprises attaching four floor engaging feet to the sofa frame at underneath each end of the lower front rail and lower back rail.

6. The method of claim 1, further comprising controlling the blow molding such that each arm rest form has an average wall thickness of 1.5 to 6 mm.

7. The method of claim 1, further comprising attaching a breast board that extends between and seats into respective breast board recesses in each of the pair of arm rest forms.

8. The method of claim 7, wherein each of the breast board recesses is defined by a vertically extending slot on an inwardly facing side of each of the respective arm rest forms and each recess further defined by an upwardly facing surface of the respective arm rest form and the method further comprises engaging each of two ends of the breast board with the respective upwardly facing surfaces.

9. The method of claim 1, further comprising selecting high molecular weight polyethylene for blowmolding.

10. A method of assembling an upholstered sofa comprising:

providing a pair of unitary, polymeric blowmolded arm rest forms;

attaching a back rest frame and a seat base to the pair of polymeric blowmolded arm rest forms by way of inserting ends of the plurality of spanning wood frame members, including a lower front rail and a lower back rail, into recesses defined in the respective polymeric blowmolded arm rest forms, whereby the arm rest forms are at a separation distance, and securing the ends to the respective arm rest forms wherein each of the spanning wood frame members has a length greater than the separation distance;

providing at least one upholstery portion form fit for each of the pair of arm rest forms and the back rest frame; and attaching the at least one upholstery portion to the pair of arm rest forms and the back rest frame.

* * * * *